US011175080B2

(12) United States Patent
Nishiyama et al.

(10) Patent No.: US 11,175,080 B2
(45) Date of Patent: Nov. 16, 2021

(54) REFRIGERATION CYCLE APPARATUS HAVING HEAT EXCHANGER SWITCHABLE BETWEEN PARALLEL AND SERIES CONNECTION

(71) Applicant: Mitsubishi Electric Corporation, Tokyo (JP)

(72) Inventors: Takumi Nishiyama, Tokyo (JP); Kosuke Tanaka, Tokyo (JP); Mitsuru Kawashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 259 days.

(21) Appl. No.: 16/326,949

(22) PCT Filed: Oct. 28, 2016

(86) PCT No.: PCT/JP2016/082120
§ 371 (c)(1),
(2) Date: Feb. 21, 2019

(87) PCT Pub. No.: WO2018/078809
PCT Pub. Date: May 3, 2018

(65) Prior Publication Data

US 2019/0277549 A1 Sep. 12, 2019

(51) Int. Cl.
*F25B 39/02* (2006.01)
*F25B 13/00* (2006.01)
(Continued)

(52) U.S. Cl.
CPC ..... *F25B 47/006* (2013.01); *F25B 13/00* (2013.01); *F25B 41/20* (2021.01); *F25B 41/26* (2021.01);
(Continued)

(58) Field of Classification Search
CPC ..... F25B 13/00; F25B 41/00; F25B 41/20; F25B 5/02; F25B 5/04; F25B 6/02;
(Continued)

(56) References Cited

U.S. PATENT DOCUMENTS

2011/0079042 A1 4/2011 Yamashita et al.
2012/0118533 A1 5/2012 Jang et al.
(Continued)

FOREIGN PATENT DOCUMENTS

JP H08-145490 A 6/1996
JP H09-264614 A 10/1997
(Continued)

OTHER PUBLICATIONS

International Search Report of the International Searching Authority dated Jan. 17, 2017 for the corresponding International application No. PCT/JP2016/082120 (and English translation).

*Primary Examiner* — Frantz F Jules
*Assistant Examiner* — Daniel C Comings
(74) *Attorney, Agent, or Firm* — Posz Law Group, PLC

(57) ABSTRACT

A refrigeration cycle apparatus includes a refrigeration circuit in which non-azeotropic refrigerant mixture circulates. The refrigeration circuit includes a compressor, an outdoor heat exchanger, an indoor heat exchanger, an expansion valve, and a four-way valve. The four-way valve is configured to assume a first state and a second state. The outdoor heat exchanger includes a plurality of refrigerant flow paths and a linear flow path switching valve configured to switch connections of the plurality of refrigerant flow paths between a series state in which the non-azeotropic refrigerant mixture flows through the plurality of refrigerant flow paths in series and a parallel state in which the non-azeotropic refrigerant mixture flows through the plurality of refrigerant flow paths in parallel. A controller switches the
(Continued)

linear flow path switching valve between the series state and the parallel state when a multi-way valve is in the second state.

9 Claims, 28 Drawing Sheets

(51) Int. Cl.

| | |
|---|---|
| ***F25B 5/02*** | (2006.01) |
| ***F25B 6/04*** | (2006.01) |
| ***F25B 47/00*** | (2006.01) |
| ***F25B 49/02*** | (2006.01) |
| ***F25B 41/20*** | (2021.01) |
| ***F25B 41/26*** | (2021.01) |

(52) U.S. Cl.
CPC ..... *F25B 49/02* (2013.01); *F25B 5/02* (2013.01); *F25B 6/04* (2013.01); *F25B 39/028* (2013.01); *F25B 2313/0276* (2013.01); *F25B 2313/02334* (2013.01); *F25B 2313/02341* (2013.01); *F25B 2313/02344* (2013.01); *F25B 2313/02533* (2013.01); *F25B 2313/02541* (2013.01); *F25B 2313/02543* (2013.01); *F25B 2313/02743* (2013.01); *F25B 2313/0314* (2013.01); *F25B 2313/0315* (2013.01); *F25B 2500/19* (2013.01); *F25B 2600/2507* (2013.01); *F25B 2600/2511* (2013.01); *F25B 2700/02* (2013.01); *F25B 2700/15* (2013.01); *F25B 2700/21174* (2013.01); *F25B 2700/21175* (2013.01)

(58) Field of Classification Search
CPC ..... F25B 6/04; F25B 25/00; F25B 2313/00; F25B 2313/023; F25B 2313/0233; F25B 2313/02331; F25B 2313/02332; F25B 2313/02334; F25B 2313/0234; F25B 2313/02341; F25B 2313/02342; F25B 2313/02344; F25B 2313/025; F25B 2313/02531; F25B 2313/02532; F25B 2313/02533; F25B 2313/0254; F25B 2313/02541; F25B 2313/02542; F25B 2313/02543; F25B 2313/0314; F25B 2313/0315; F25B 41/26; F25B 2500/19; F25B 2600/2507; F25B 2700/02; F25B 2700/15; F25B 2700/21174; F25B 2700/21175; F25B 39/028; F25B 47/006; F25B 2600/2511
USPC ..... 62/198, 199, 200, 504
See application file for complete search history.

(56) References Cited

U.S. PATENT DOCUMENTS

| | | | | |
|---|---|---|---|---|
| 2012/0260678 | A1* | 10/2012 | Yoshida | F25B 41/31 62/56 |
| 2016/0018135 | A1 | 1/2016 | Yuzawa et al. | |
| 2017/0002245 | A1 | 1/2017 | Fukushima | |
| 2017/0138641 | A1 | 5/2017 | Fujitaka et al. | |
| 2017/0282689 | A1* | 10/2017 | Miyakoshi | B60H 1/00921 |

FOREIGN PATENT DOCUMENTS

| | | | |
|---|---|---|---|
| JP | 2001-099510 | A | 4/2001 |
| JP | 2009-257741 | A | 11/2009 |
| JP | 2010-223547 | A | 10/2010 |
| JP | 2010-249484 | A | 11/2010 |
| JP | 2012-077921 | A | 4/2012 |
| JP | 2012-087959 | A | 5/2012 |
| JP | 2015-117936 | A | 6/2015 |
| JP | 2015-214929 | A | 12/2015 |
| WO | 2009/154149 | A1 | 12/2009 |
| WO | 2010/002014 | A1 | 1/2010 |
| WO | 2014/156190 | A1 | 10/2014 |
| WO | 2015/141678 | A1 | 9/2015 |
| WO | 2015/174032 | A1 | 11/2015 |

* cited by examiner (DURING CONDENSATION)

(DURING EVAPORATION AND DURING SELECTION OF A LARGE NUMBER OF FLOW PATHS)

(DURING EVAPORATION AND DURING SELECTION OF A SMALL NUMBER OF FLOW PATHS)

<A SMALL NUMBER OF FLOW PATHS>

<A LARGE NUMBER OF FLOW PATHS>

REFRIGERATION CYCLE APPARATUS HAVING HEAT EXCHANGER SWITCHABLE BETWEEN PARALLEL AND SERIES CONNECTION

CROSS REFERENCE TO RELATED APPLICATION

This application is a U.S. national stage application of International Application PCT/JP2016/082120, filed on Oct. 28, 2016, the contents of which are incorporated herein by reference.

TECHNICAL FIELD

The present invention relates to refrigeration cycle apparatuses, and particularly, to a refrigeration cycle apparatus in which the number of flow paths of an evaporator is configured to reduce a temperature difference in the temperature of refrigerant in the evaporator.

BACKGROUND

In an air conditioning apparatus, in order to effectively utilize the performance of a heat exchanger and perform an operation for increased efficiency, the following is effective in principle: for a condenser, the heat exchanger is used with a reduced number of branches at a fast flow rate, and for an evaporator, the heat exchanger is used with an increased number of branches at a slow flow rate. This is because heat transfer depending on a flow rate is dominant in improving performance in the condenser, and reducing a pressure loss depending on a flow rate is dominant in improving performance in the evaporator.

For example, Japanese Patent Laying-Open No. 2015-117936 (PTL 1) proposes an outdoor heat exchanger reflecting such characteristics of the condenser and the evaporator. This heat exchanger can change the number or length of flow paths through which refrigerant passes by connecting at least two unit flow paths of a plurality of unit flow paths in series or in parallel depending on whether cooling operation or heating operation is performed. Since the outdoor heat exchanger is used by appropriately selecting and using the number or length of flow paths, efficiency can be improved.

In order to reduce a global warming potential (GWP), the introduction of non-azeotropic refrigerant mixture, which has a low global warming potential and is incombustible, into a refrigeration cycle apparatus has been studied (WO 2010/002014 (PTL 2)).

PATENT LITERATURE

PTL 1: Japanese Patent Laying-Open No. 2015-117936

PTL 2: WO 2010/002014

Non-azeotropic refrigerant mixture which has a low global warming potential and is incombustible may have a varying temperature difference between a refrigerant temperature at an inlet of an evaporator and a refrigerant temperature at an outlet of the evaporator depending on its use, resulting in the refrigerant temperature at the inlet which is lower than the refrigerant temperature at the outlet. In such a case, frost may be formed at the inlet portion of the evaporator, and a defrosting operation may be started though frost is not formed in most of the evaporator, leading to reduced efficiency of a refrigeration cycle. Also, partial dew condensation occurring in the evaporator reduces the efficiency of the heat exchanger.

SUMMARY

The present invention has been made to solve the above problems, and has an object to provide a refrigeration cycle apparatus that prevents partial frost formation and partial dew condensation and has an improved efficiency.

A refrigeration cycle apparatus disclosed in an embodiment of the present application includes a refrigeration circuit in which non-azeotropic refrigerant mixture circulates. The refrigeration circuit includes a compressor, a first heat exchanger, a second heat exchanger, an expansion valve, and a multi-way valve. The multi-way valve is configured to assume a first state and a second state. In the first state, the non-azeotropic refrigerant mixture flows in order of the first heat exchanger, the expansion valve, and the second heat exchanger in the refrigeration circuit. In the second state, the non-azeotropic refrigerant mixture flows in order of the second heat exchanger, the expansion valve, and the first heat exchanger in the refrigeration circuit. The first heat exchanger includes a plurality of refrigerant flow paths and a flow path switching device configured to switch connections of the plurality of refrigerant flow paths between (a) a series state in which the non-azeotropic refrigerant mixture flows through the plurality of refrigerant flow paths in series and (b) a parallel state in which the non-azeotropic refrigerant mixture flows through the plurality of refrigerant flow paths in parallel. A controller switches the flow path switching device between the series state and the parallel state when the multi-way valve is in the second state.

In the present invention, the connections of the plurality of refrigerant flow paths of the evaporator are changed during operation so as to appropriately switch the number of flow paths, preventing partial frost formation and partial dew condensation, which improves the operation efficiency of the refrigeration cycle apparatus.

DETAILED DESCRIPTION

Figure 1:
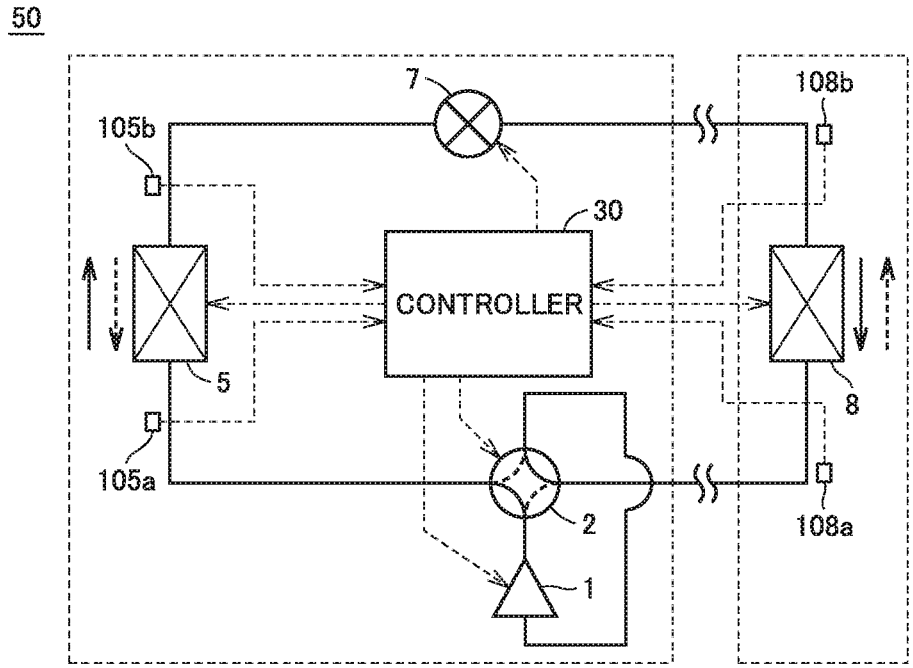
FIG. 1 is a block diagram showing a configuration of a refrigeration cycle apparatus of Embodiment 1.

Embodiments of the present invention will be described below in detail with reference to the drawings. In the drawings described hereinafter, the relationship between the constituent members in terms of size may not be the same as that of the actual one. Also, in the drawings described hereinafter, identical or corresponding parts are identically denoted, which is common throughout the specification. Further, the modes of the constituent elements described throughout the specification are merely by way of example, and they are not limited to the description.

Embodiment 1

FIG. 1 is a block diagram showing a configuration of a refrigeration cycle apparatus of Embodiment 1. With reference to FIG. 1, a refrigeration cycle apparatus 50 includes a compressor 1, a four-way valve 2, an outdoor heat exchanger 5, an expansion valve 7, and an indoor heat exchanger 8. These components are connected by pipes, thereby constituting a refrigeration circuit.

Refrigeration cycle apparatus 50 further includes temperature sensors 105*a*, 105*b*, 108*a*, and 108*b*, and a controller 30. Temperature sensors 105*a* and 105*b* detect the temperatures at a refrigerant inlet and a refrigerant outlet of outdoor heat exchanger 5, and controller 30 detects a temperature difference between the refrigerant inlet and the refrigerant outlet of outdoor heat exchanger 5. Temperature sensors 108*a* and 108*b* detect the temperatures at the refrigerant inlet and the refrigerant outlet of indoor heat exchanger 8, and controller 30 detects a temperature difference between the refrigerant inlet and the refrigerant outlet of indoor heat exchanger 8.

Compressor 1, four-way valve 2, outdoor heat exchanger 5, expansion valve 7, temperature sensors 105*a* and 105*b*, and controller 30 are placed in an outdoor unit. Temperature sensors 108*a* and 108*b* and indoor heat exchanger 8 are placed in an indoor unit.

Switching four-way valve 2 causes indoor heat exchanger 8 placed in the indoor unit to serve as a condenser and outdoor heat exchanger 5 placed in the outdoor unit to serve as an evaporator during heating operation, and causes outdoor heat exchanger 5 to serve as a condenser and indoor heat exchanger 8 to serve as an evaporator during cooling operation.

Description will now be given of a basic operation of refrigeration cycle apparatus 50 according to Embodiment 1 which has the above configuration.

During basic operation (heating), refrigerant circulates in order of H1 to H3 below.

H1: high-temperature, high-pressure refrigerant is discharged from compressor 1 and flows through four-way valve 2, in which flow paths indicated by broken lines are formed, into indoor heat exchanger 8, and the resultant refrigerant condenses.

H2: the liquid refrigerant that has condensed expands in expansion valve 7 to have a low temperature and a low pressure and flows into outdoor heat exchanger 5, and the resultant refrigerant evaporates.

H3: the refrigerant (gas) that has evaporated returns to compressor 1 through four-way valve 2.

During basic operation (cooling), refrigerant circulates in order of C1 to C3 below.

C1: high-temperature, high-pressure refrigerant is discharged from compressor 1 and flows through four-way valve 2, in which flow paths indicated by solid lines are formed, into outdoor heat exchanger 5, and the resultant refrigerant condenses.

C2: the liquid refrigerant that has condensed expands in expansion valve 7 to have a low temperature and a low pressure and flows into indoor heat exchanger 8, and the resultant refrigerant evaporates.

C3: the refrigerant (gas) that has evaporated returns to compressor 1 through four-way valve 2.

In such a configuration, when non-azeotropic refrigerant mixture is used, a temperature difference is caused between the refrigerant inlet and the refrigerant outlet in the evaporator. In this case, partial frost formation or partial dew condensation may occur to reduce heat exchange efficiency, and a cooling or heating operation may be interrupted to frequently cause a defrosting operation. In the present embodiment, thus, the configuration of flow paths of a heat exchanger is changed in accordance with a temperature difference in order to prevent frequent occurrence of a defrosting operation by reducing a temperature difference between the refrigerant inlet and the refrigerant outlet of the heat exchanger operating as an evaporator.

Figure 2:
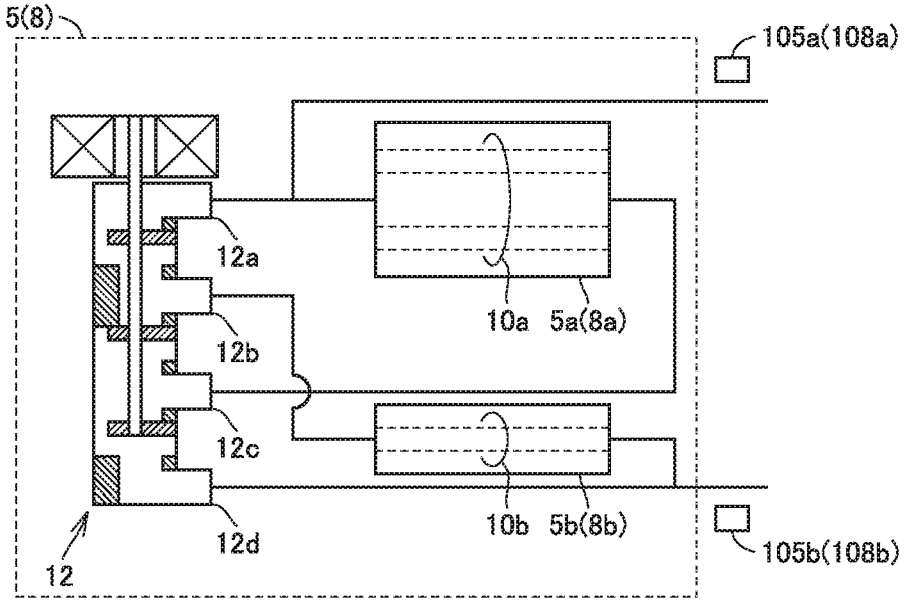
FIG. 2 is a block diagram showing configurations of an outdoor heat exchanger 5 and an indoor heat exchanger 8.

FIG. 2 is a block diagram showing configurations of outdoor heat exchanger 5 and indoor heat exchanger 8. With reference to FIG. 2, outdoor heat exchanger 5 (or indoor heat exchanger 8) operating as an evaporator is divided into a first heat exchange unit 5*a* (8*a*) having a first number of refrigerant flow paths 10*a* of a plurality of refrigerant flow paths and a second heat exchange unit 5*b* (8*b*) having a second number of refrigerant flow paths 10*b* of the plurality of refrigerant flow paths. The second number is smaller than the first number. A linear flow path switching valve 12 operating as a flow path switching device switches a connection path between first heat exchange unit 5*a* (8*a*) and second heat exchange unit 5*b* (8*b*) between a first manner of flowing non-azeotropic refrigerant mixture through first heat exchange unit 5*a* (8*a*) and second heat exchange unit 5*b* (8*b*) in parallel and a second manner of flowing non-azeotropic refrigerant mixture through first heat exchange unit 5*a* (8*a*) and second heat exchange unit 5*b* (8*b*) in series.

Controller 30 can switch a flow to each heat exchanger by operating linear flow path switching valve 12 based on the results detected by temperature sensors 105*a* and 105*b* (108*a*, 108*b*).

Outdoor heat exchanger 5 and indoor heat exchanger 8 each have a heat exchanger divided into two or more parts, and have a smaller number of flow paths (hereinafter, also referred to as a path number) and a smaller capacity on the liquid side (downstream) during condensation (capacity: 5*a*>5*b*, 8*a*>8*b*, path number: 5*a*>5*b*, 8*a*>8*b*).

Linear flow path switching valve 12 may be, for example, a valve that moves a valve main body by a motor and a screw mechanism, or a solenoid valve that moves a valve main body by moving a piece of iron (plunger) by an electromagnet (solenoid). These valves are preferably used because they do not require a differential pressure in flow paths in switching, unlike a four-way valve.

Figure 3:
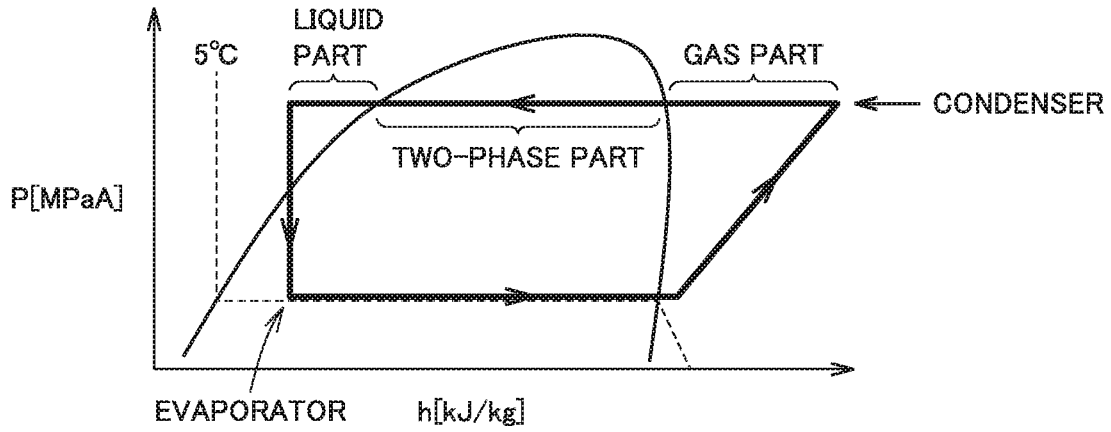
FIG. 3 is a p-h diagram showing a refrigeration cycle and an isothermal line of normal refrigerant.
Figure 4:
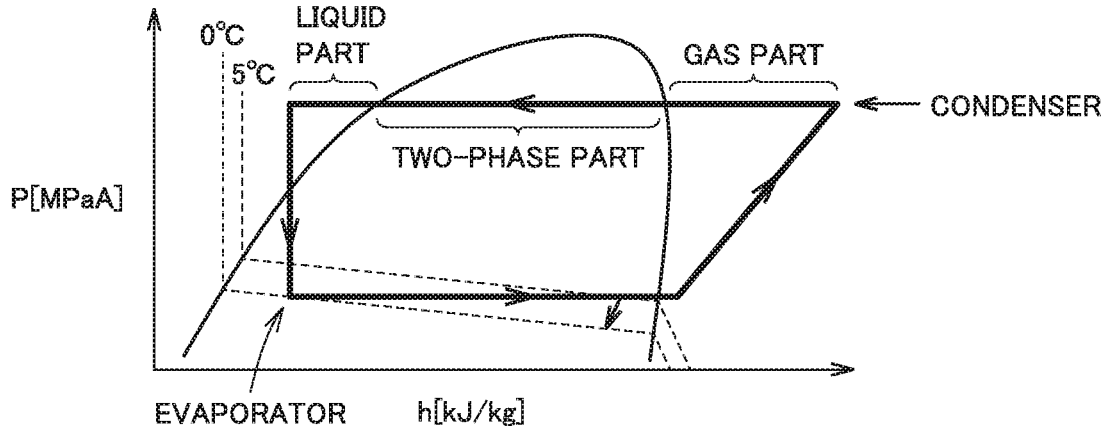
FIG. 4 is a p-h diagram showing a refrigeration cycle and isothermal lines of non-azeotropic refrigerant mixture.

A temperature difference between the refrigerant inlet and the refrigerant outlet of the evaporator will now be described. FIG. 3 is a p-h diagram showing a refrigeration cycle and an isothermal line of normal refrigerant. FIG. 4 is a p-h diagram showing a refrigeration cycle and isothermal lines of non-azeotropic refrigerant mixture.

As shown in FIG. 3, for normal refrigerant, the isothermal line drawn on the p-h diagram has an equal pressure in a region between a saturated liquid line and a saturated vapor line. That is to say, the isothermal line is horizontal as indicated by the broken line (5° C.) in FIG. 3. This means that the temperature and pressure of two-phase refrigerant are equal within the evaporator.

Contrastingly, as shown in FIG. 4, for non-azeotropic refrigerant mixture, a plurality of refrigerants having different boiling points are mixed. Thus, a refrigerant having a lower boiling point evaporates earlier, and a refrigerant having a higher boiling point evaporates later, providing a downward-sloping gradient to the isothermal line. This gradient is referred to as a temperature glide.

At a constant pressure of refrigerant, the refrigerant temperature rises toward the outlet in the evaporator, and a temperature difference between saturated liquid and saturated vapor is as much as five degrees or more.

As the humidity around the evaporator is high and the evaporator inlet has a minus temperature in the above-mentioned state, partial frost formation occurs near the inlet of the evaporator. Since many refrigeration cycle apparatuses are controlled to perform a defrosting operation at the occurrence of frost formation, they shift to the defrosting operation due to interruption of a heating or cooling operation. Frequent occurrence of defrosting operation reduces the efficiency of the refrigeration cycle apparatus. Also when the refrigeration cycle apparatus is not shifted to the defrosting operation, partial frost formation or partial dew condensation unfavorably reduces the heat exchange efficiency of the evaporator. Considering the above, the configuration of flow paths of the evaporator is changed to reduce a temperature difference between the refrigerant inlet and the refrigerant outlet of the evaporator in the present embodiment, as will be described in detail with reference to FIG. 14 and the following figures. As a result of changing the configuration of flow paths, an evaporation step in an evaporator of a refrigeration cycle of FIG. 4 changes so as to be closer to the downward-sloping isothermal line on the p-h diagram.

The types and compositions of various non-azeotropic refrigerant mixtures applicable to the present embodiment will now be described.

Refrigerants conventionally used in air conditioners, refrigerator, and the like are, for example, chlorofluorocarbon (CFC) and hydrochlorofluorocarbon (HCFC). Chlorine-containing refrigerants such as CFC and HCFC, however, greatly affect the ozone layer in the stratosphere, and accordingly, their use is currently restricted.

From the above reason, hydrofluorocarbon (HFC), which contains no chlorine and little affects the ozone layer, is currently used as refrigerant. Known as such HFC is difluoromethane (also referred to as methylene fluoride, chlorofluorocarbon 32, HFC-32, or R32, referred to as "R32" below). Known as any other HFC is tetrafluoroethane or R125 (1,1,1,2,2-pentafluoroethane). In particular, R410A (pseudo-azeotropic refrigerant mixture of R32 and R125), which has high refrigerating capacity, is widely used.

However, it is pointed out that a refrigerant such as R32 having a global warming potential (GWP) of 675 is attributable to global warming. The development of a refrigerant that has a smaller GWP and little affects the ozone layer is thus desired.

Known as the refrigerant (working medium for heat cycle) that little affects global warming and can achieve cycle performance sufficient for a heat cycle system is a refrigerant containing trifluoroethylene (also referred to as 1,1,2-trifluoroethene, HFO1123, or R1123, referred to as "R1123" below) which has a GWP of about 0.3. Since R1123 has a carbon-carbon double bond that is easily decomposed by OH radicals in the air, it conceivably affects the ozone layer little.

A refrigerant containing HFO1123, 2,3,3,3-tetrafluoropropene (also referred to as 2,3,3,3-tetrafluoro-1-propne, HFO-1234yf, or R1234yf, referred to as "R1234yf" below), and R32 is also known.

[Composition of Non-Azeotropic Refrigerant Mixture]

FIGS. 5 to 13 show mass ratios of three components, (R1234yf, R32, R125) or (R1123, R32, R125), in the non-azeotropic refrigerant mixture according to the present invention.

Each figure shows an overlapping region range of a composition range, which has a GWP of 1500 to 2000 with respect to a GWP of 2090 of R410A that is a conventional refrigerant, and a composition range in which refrigerant is incombustible in a mixed refrigerant composition. In consideration of the use at a low temperature of −40° C., composition ranges in which the temperature of saturated gas at atmospheric pressure is at least −40° C., −45° C., and −50° C. or less are shown separately. The temperature of saturated gas at atmospheric pressure is preferably −40° C. or lower, is more preferably −45° C. or lower, and is still more preferably 50° C. or lower (the temperatures of saturated gas are all lower than −50° C. in the range in mixing with R1123).

It is preferable that in the above composition range, refrigerant have a lower GWP as the temperature of saturated gas at atmospheric pressure is lower and be incombustible. Cross points (points A, D, F, C1) between the boundary for incombustibility and a GWP are most preferable in the above composition range.

The composition range shown in each figure will be described below in detail. The composition range available at a boiling point of −40° C. or lower will now be described with reference to FIGS. 5 to 7.

Figure 5:
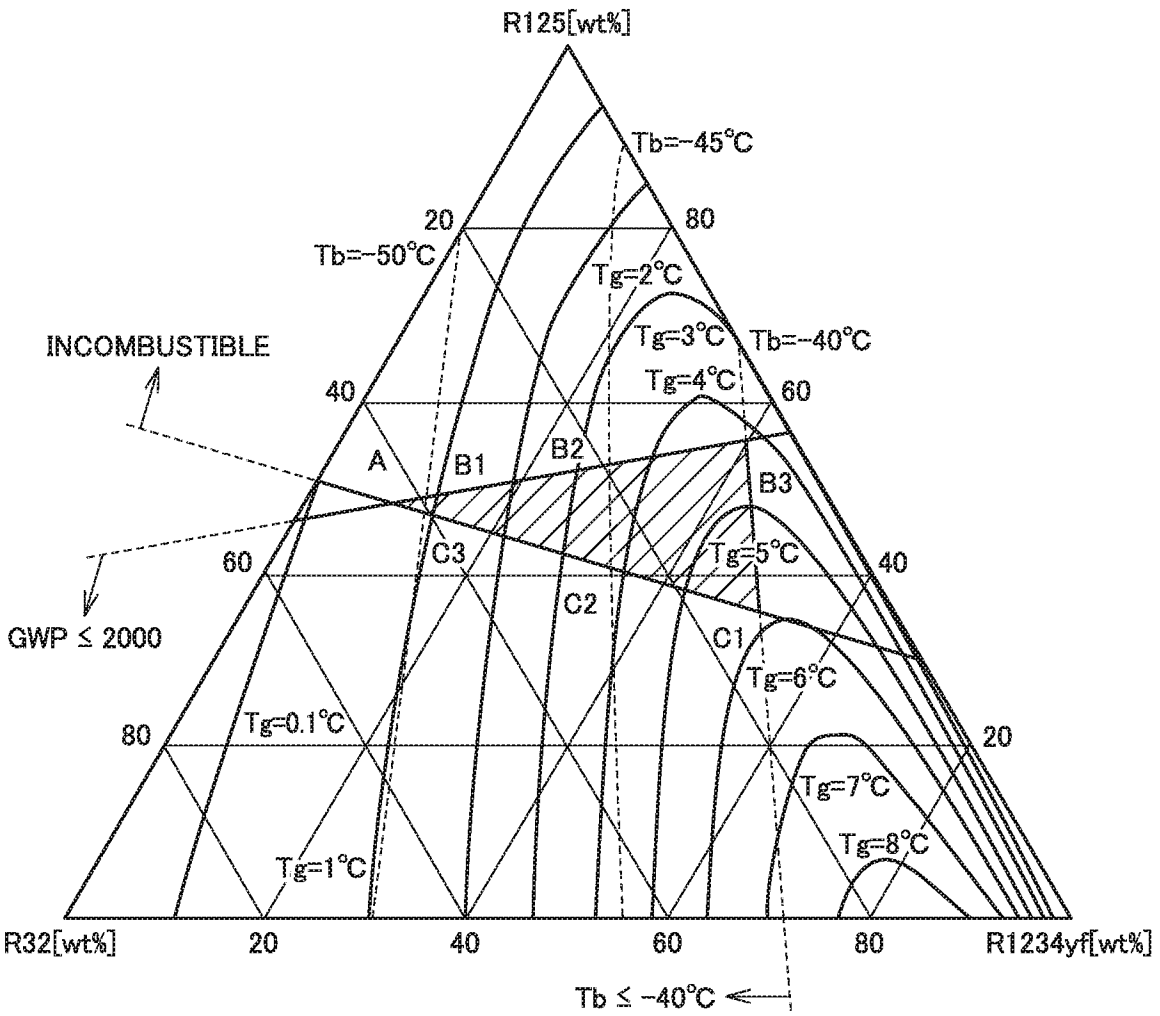
FIG. 5 shows a first example of a composition range of non-azeotropic refrigerant mixture (R1234yf:R32:R125).

FIG. 5 shows a first example of a composition range of non-azeotropic refrigerant mixture (R1234yf:R32:R125). This composition range is a range in which the non-azeotropic refrigerant mixture can be used at a boiling point of −40° C. or lower, is incombustible, has a GWP of equal to or less than 2000, and contains R1234yf, R32, and R125, and the mass ratio of the three components falls within the range with three points, A, B3, and C1 below as vertices.

A) R1234yf:R32:R125=7.4:44.0:48.6 wt %

B3) R1234yf:R32:R125=39.5:4.2:56.3 wt %

C1) R1234yf:R32:R125=51.3:13.0:35.8 wt %

Figure 6:
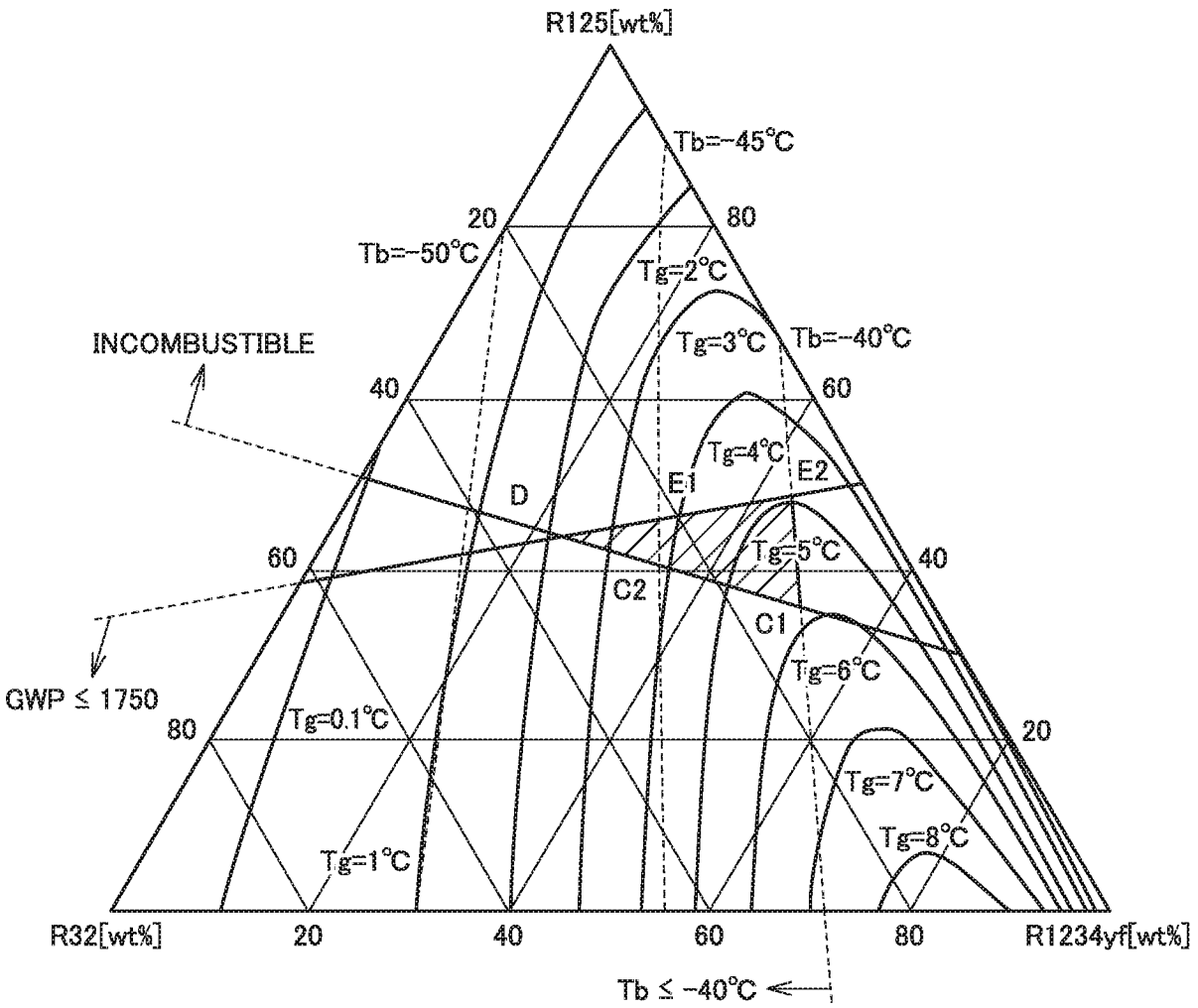
FIG. 6 shows a second example of the composition range of the non-azeotropic refrigerant mixture (R1234yf:R32:R125).

FIG. 6 shows a second example of the composition range of the non-azeotropic refrigerant mixture (R1234yf:R32:R125). This composition range is a range in which the non-azeotropic refrigerant mixture can be used at a boiling point of −40° C. or lower, is incombustible, has a GWP of equal to or less than 1750, and contains R1234yf, R32, and R125, and the mass ratio of the three components falls within the range with three points, D, E2, and C1 below as vertices.

D) R1234yf:R32:R125=23.1:33.4:43.5 wt %

E2) R1234yf:R32:R125=43.9:7.6:48.5 wt %

C1) R1234yf:R32:R125=51.3:13.0:35.8 wt %

Figure 7:
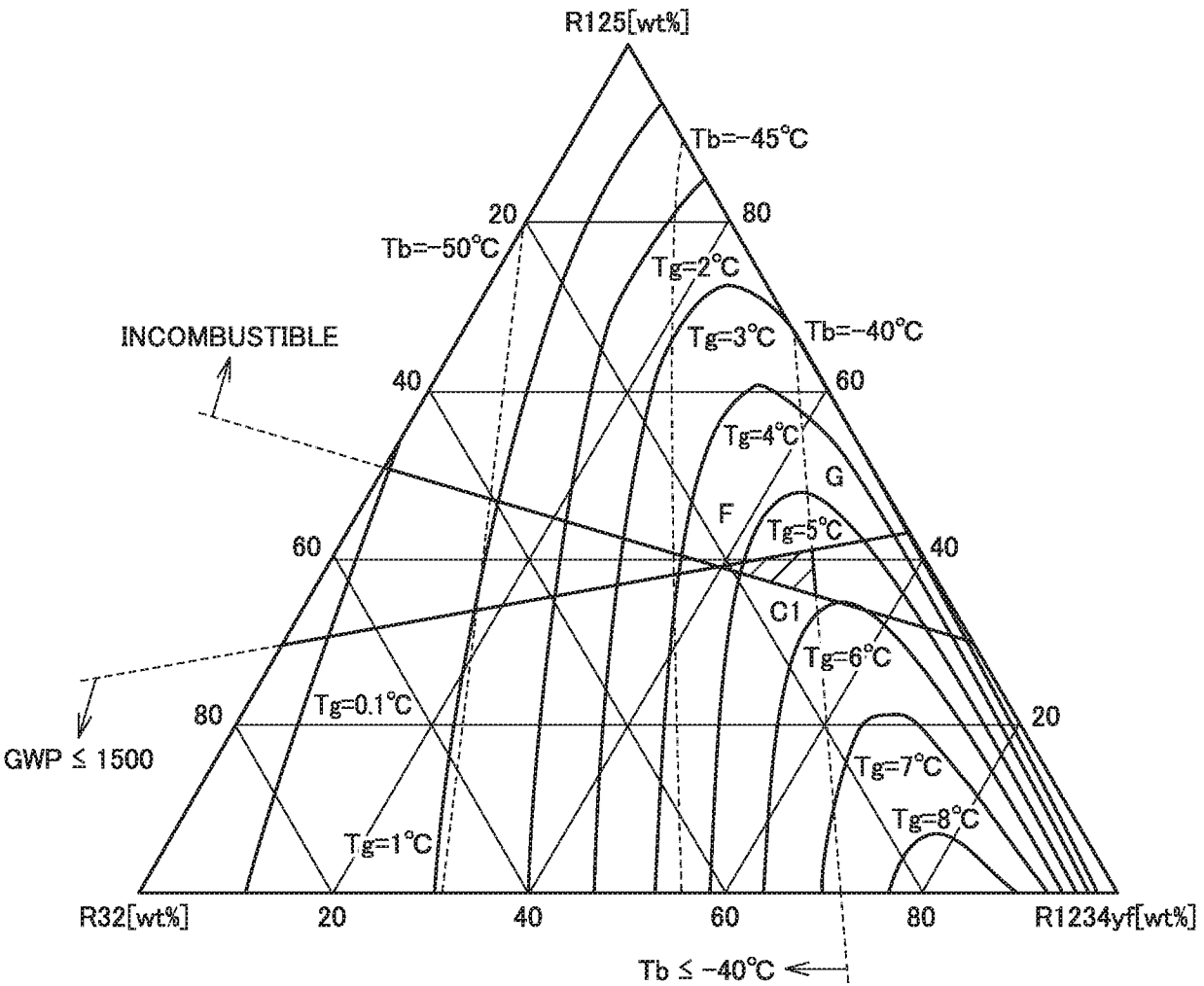
FIG. 7 shows a third example of the composition range of the non-azeotropic refrigerant mixture (R1234yf:R32:R125).

FIG. 7 shows a third example of the composition range of the non-azeotropic refrigerant mixture (R1234yf:R32:R125). This composition range is a range in which the non-azeotropic refrigerant mixture can be used at a boiling point of −40° C. or lower, is incombustible, has a GWP of equal to or less than 1500, and contains R1234yf, R32, and R125, and the mass ratio of the three components falls within the range with three points, F, G, and C1 below as vertices.

F) R1234yf:R32:R125=40.2:21.0:38.8 wt %

G) R1234yf:R32:R125=48.4:10.9:40.7 wt %

C1) R1234yf:R32:R125=51.3:13.0:35.8 wt %

The composition ranges shown in FIGS. 5 to 7 are composition ranges in which the temperature of saturated gas at atmospheric pressure is −40° C. or lower, non-azeotropic refrigerant mixture is incombustible while preventing from having a negative pressure even at an evaporation temperature of −40° C., and further, GWP can become lower than that of R410A conventionally used mainly in the field of air conditioning and refrigeration (−40° C. corresponds to an evaporation temperature in a refrigerator).

Compared with R410A, the non-azeotropic refrigerant mixture can have high capability at high outdoor temperature. This is because increasing the composition ratio of R1234yf reduces operating pressure, and accordingly, condensation temperature can be increased at high outdoor temperature, thereby improving the capability that can be output (when a pressure at which reliability can be secured is an upper limit, a higher-pressure refrigerant has a lower condensation temperature, and accordingly, a temperature difference between the condensation temperature and the temperature of air decreases).

The composition ranges in which the non-azeotropic refrigerant mixture can be used at a boiling point of −45° C. or lower will now be described with reference to FIGS. 8 and 9. In this case, refrigerant can prevent from having a negative pressure also in a lower-temperature region, has increased capability at high outdoor temperature, is incombustible, and has a low GWP.

Figure 8:
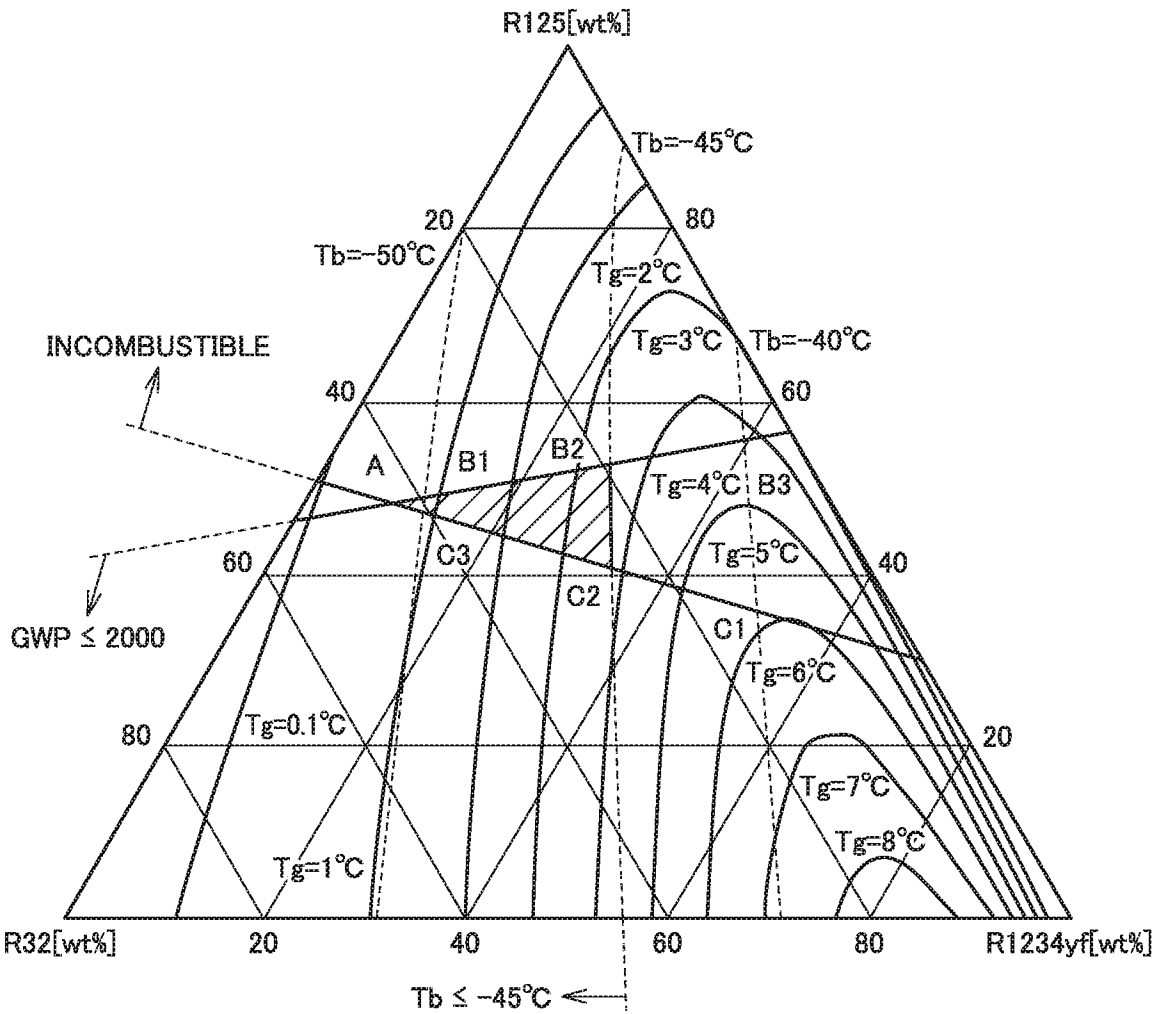
FIG. 8 shows a fourth example of the composition range of the non-azeotropic refrigerant mixture (R1234yf:R32:R125).

FIG. 8 shows a fourth example of the composition range of the non-azeotropic refrigerant mixture (R1234yf:R32:R125). This composition range is a range in which the non-azeotropic refrigerant mixture can be used at a boiling point of −45° C. or lower, is incombustible, has a GWP of equal to or less than 2000, and contains R1234yf, R32, and R125, and the mass ratio of the three components falls within the range with three points, A, B2, and C2 below as vertices.

A) R1234yf:R32:R125=7.4:44.0:48.6 wt %

B2) R1234yf:R32:R125=27.9:18.6:53.5 wt %

C2) R1234yf:R32:R125=34.8:25.2:40.0 wt %

Figure 9:
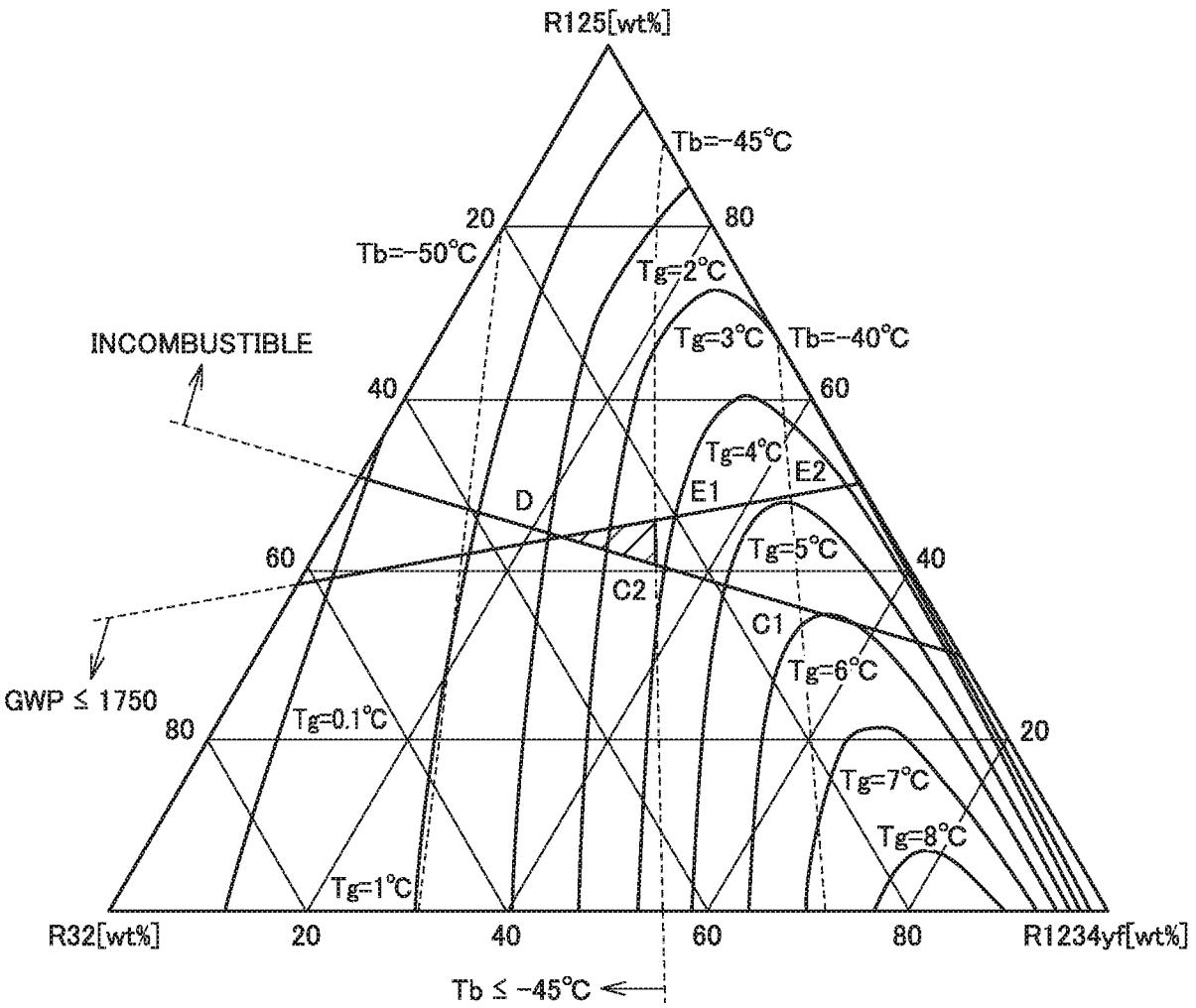
FIG. 9 shows a fifth example of the composition range of the non-azeotropic refrigerant mixture (R1234yf:R32:R125).

FIG. 9 shows a fifth example of the composition range of the non-azeotropic refrigerant mixture (R1234yf:R32:R125). This composition range is a range in which the non-azeotropic refrigerant mixture can be used at a boiling point of −45° C. or lower, is incombustible, has a GWP of equal to or less than 1750, and contains R1234yf, R32, and R125, and the mass ratio of the three components falls within the range with three points, D, E1, and C2 below as vertices.

D) R1234yf:R32:R125=23.1:33.4:43.5 wt %

E1) R1234yf:R32:R125=31.9:22.4:45.6 wt %

C2) R1234yf:R32:R125=34.8:25.2:40.0 wt %

The composition ranges shown in FIGS. 8 and 9 are composition ranges in which the temperature of saturated gas at atmospheric pressure is −45° C. or lower, the non-azeotropic refrigerant mixture is incombustible while preventing from having a negative pressure even at an evaporation temperature of −45° C., and further, GWP can become lower than that of R410A conventionally used mainly in the field of air conditioning and refrigeration. Also, the capability at high outdoor temperature can be made higher than that of R410A.

The composition range in which the non-azeotropic refrigerant mixture can be used at a boiling point of −50° C. or lower will now be described with reference to FIG. 10. In this case, refrigerant can prevent from having a negative pressure also in a lower-temperature region, has increased capability at high outdoor temperature, is incombustible, and has a low GWP.

Figure 10:
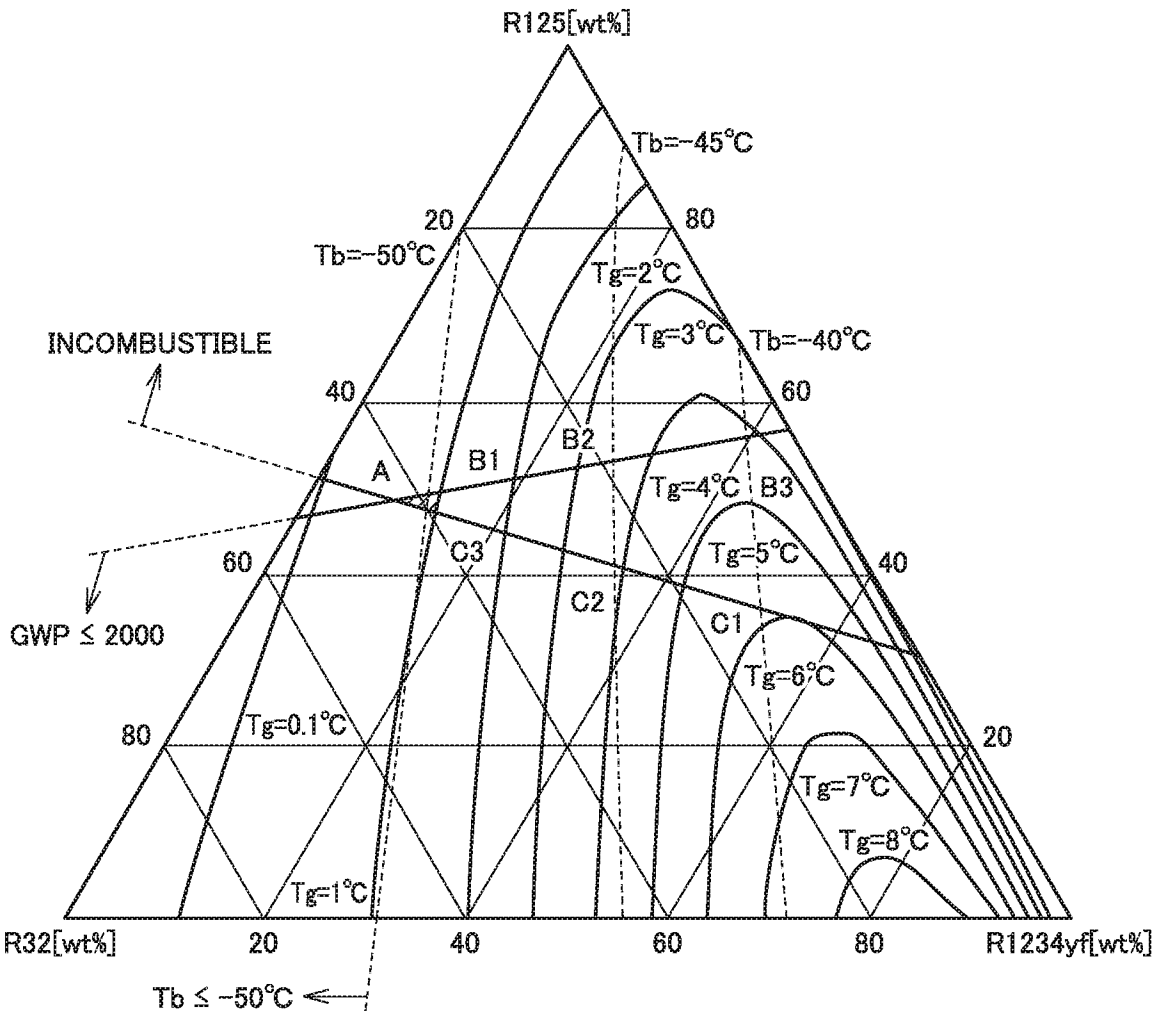
FIG. 10 shows a sixth example of the composition range of the non-azeotropic refrigerant mixture (R1234yf:R32:R125).

FIG. 10 shows a sixth example of the composition range of the non-azeotropic refrigerant mixture (R1234yf:R32:R125). This composition range is a range in which the non-azeotropic refrigerant mixture can be used at a boiling point of −50° C. or lower, is incombustible, and has a GWP of equal to or lower than 2000, contains R1234yf, R32, and R125, and the mass ratio of the three components falls within the range with three points, A, B1, and C3 below as vertices.

A) R1234yf:R32:R125=7.4:44.0:48.6 wt %

B1) R1234yf:R32:R125=10.9:39.6:49.5 wt %

C3) R1234yf:R32:R125=11.7:40.8:47.5 wt %

The composition range shown in FIG. 10 is a composition range in which the temperature of saturated gas at atmospheric pressure is −50° C. or lower, the non-azeotropic refrigerant mixture is incombustible while preventing from having a negative pressure even at an evaporation temperature of −50° C., and further, GWP can become lower than that of R410A conventionally used mainly in the field of air conditioning and refrigeration. Also, the capability at high outdoor temperature is made higher than that of R410A.

Figure 11:
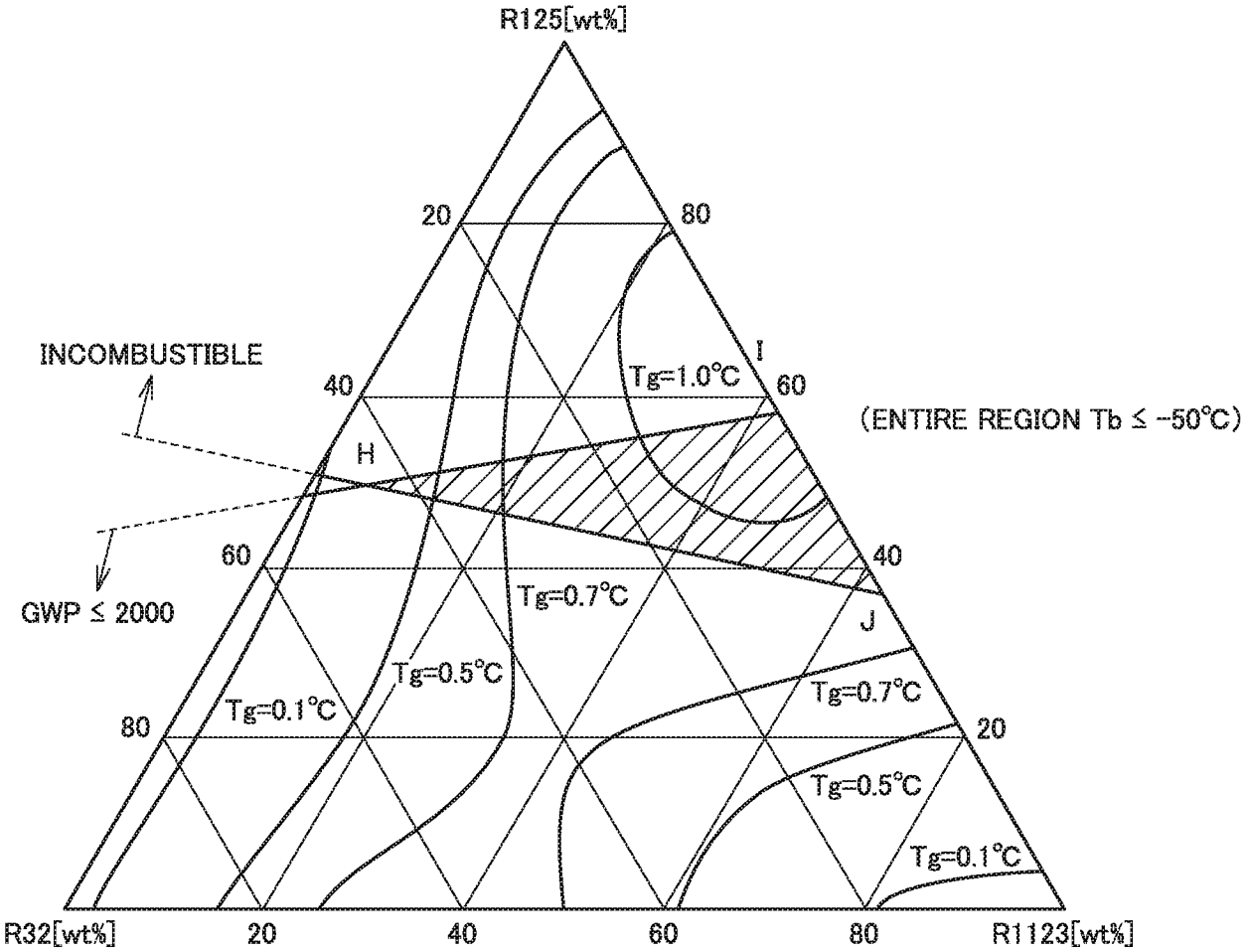
FIG. 11 shows a first example of a composition range of non-azeotropic refrigerant mixture (R1123:R32:R125).

Refrigerant containing R1123 in place of R1234yf will now be described. FIG. 11 shows a first example of a composition range of non-azeotropic refrigerant mixture (R1123:R32:R125). This composition range is a range in which the non-azeotropic refrigerant mixture can be used at a boiling point of −50° C. or lower, is incombustible, has a GWP of equal to or less than 2000, and contains R1123, R32, and R125, and the mass ratio of the three components falls within the range with three points, H, I, and J below as vertices.

H) R1123:R32:R125=6.7:44.8:48.5 wt %

I) R1123:R32:R125=42.9:0:57.1 wt %

J) R1123:R32:R125=62.7:0:37.3 wt %

Figure 12:
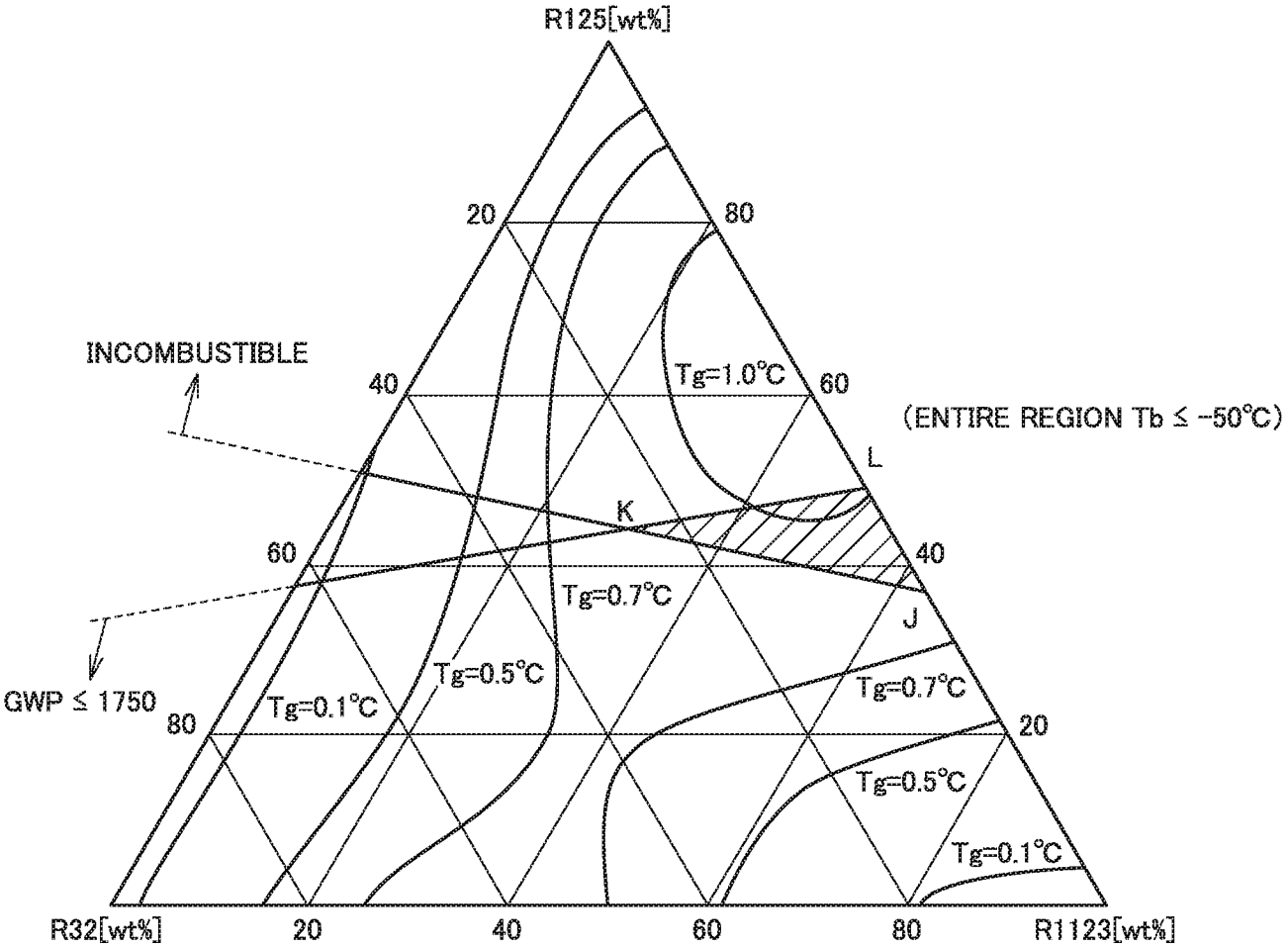
FIG. 12 shows a second example of the composition range of the non-azeotropic refrigerant mixture (R1123:R32:R125).

FIG. 12 shows a second example of the composition range of the non-azeotropic refrigerant mixture (R1123:R32:R125). This composition range is a range in which the non-azeotropic refrigerant mixture can be used at a boiling point of −50° C. or lower, is incombustible, has a GWP of equal to or less than 1750, and contains R1123, R32, and R125, and the mass ratio of the three components falls within the range with three points, K, L, and J below as vertices.

K) R1123:R32:R125=27.0:28.5:44.5 t %

L) R1123:R32:R125=50.1:0:49.9 wt %

J) R1123:R32:R125=62.7:0:37.3 wt %

Figure 13:
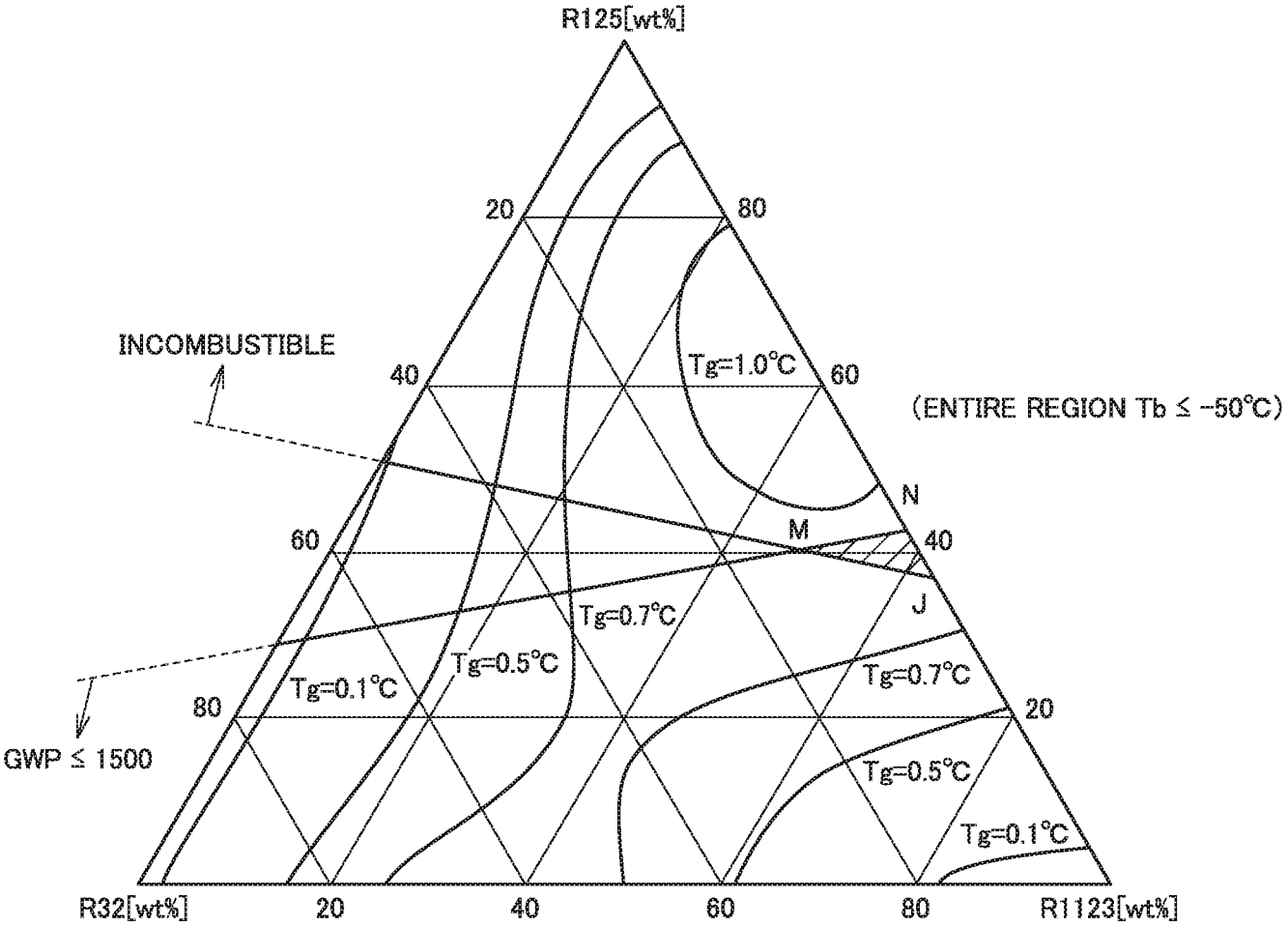
FIG. 13 shows a third example of the composition range of the non-azeotropic refrigerant mixture (R1123:R32:R125).

FIG. 13 shows a third example of the composition range of the non-azeotropic refrigerant mixture (R1123:R32:R125). This composition range is a range in which the non-azeotropic refrigerant mixture can be used at a boiling point of −50° C. or lower, is incombustible, has a GWP of equal to or less than 1500, and contains R1123, R32, and R125, and the mass ratio of the three components falls within the range with three points, M, N, and J below as vertices.

M) R1123:R32:R125=46.7:13.0:40.3 wt %

N) R1123:R32:R125=57.2:0:42.8 wt %

J) R1123:R32:R125=62.7:0:42.8 wt %

The composition ranges shown in FIGS. 11 to 13 are composition ranges in which the temperature of saturated gas at atmospheric pressure is −50° C. or lower, the non-azeotropic refrigerant mixture is incombustible while preventing from having a negative pressure at an evaporation temperature of −50° C., and further, GWP can become lower than that of R410A conventionally used mainly in the field of air conditioning and refrigeration.

The use of the non-azeotropic refrigerant mixtures shown in FIGS. 5 to 13 can prevent from providing a negative pressure in the operation range, thereby preventing contamination of air.

The composition ranges (points A to G) shown in FIGS. 5 to 9 can reduce a discharge temperature by 6.4° C. to 44.7° C. and reduce operating pressure at high pressure by 3 to 33% from the results of theoretical calculation performed assuming that condensation temperature is 42° C., evaporation temperature is −40° C., inlet SH is 10 degrees, SC is 5 degrees, and compressor efficiency is 0.8.

Also, the composition ranges (points H to N) shown in FIGS. 10 to 13 can reduce discharge temperature by 3.2° C. to 37.1° C.

A decrease in operating pressure leads to improvement in reliability in view of the resistance to pressure of the compressor. Also, a decrease in discharge temperature leads to improvement in reliability in view of the resistance to pressure of parts used in the compressor.

Figure 29:
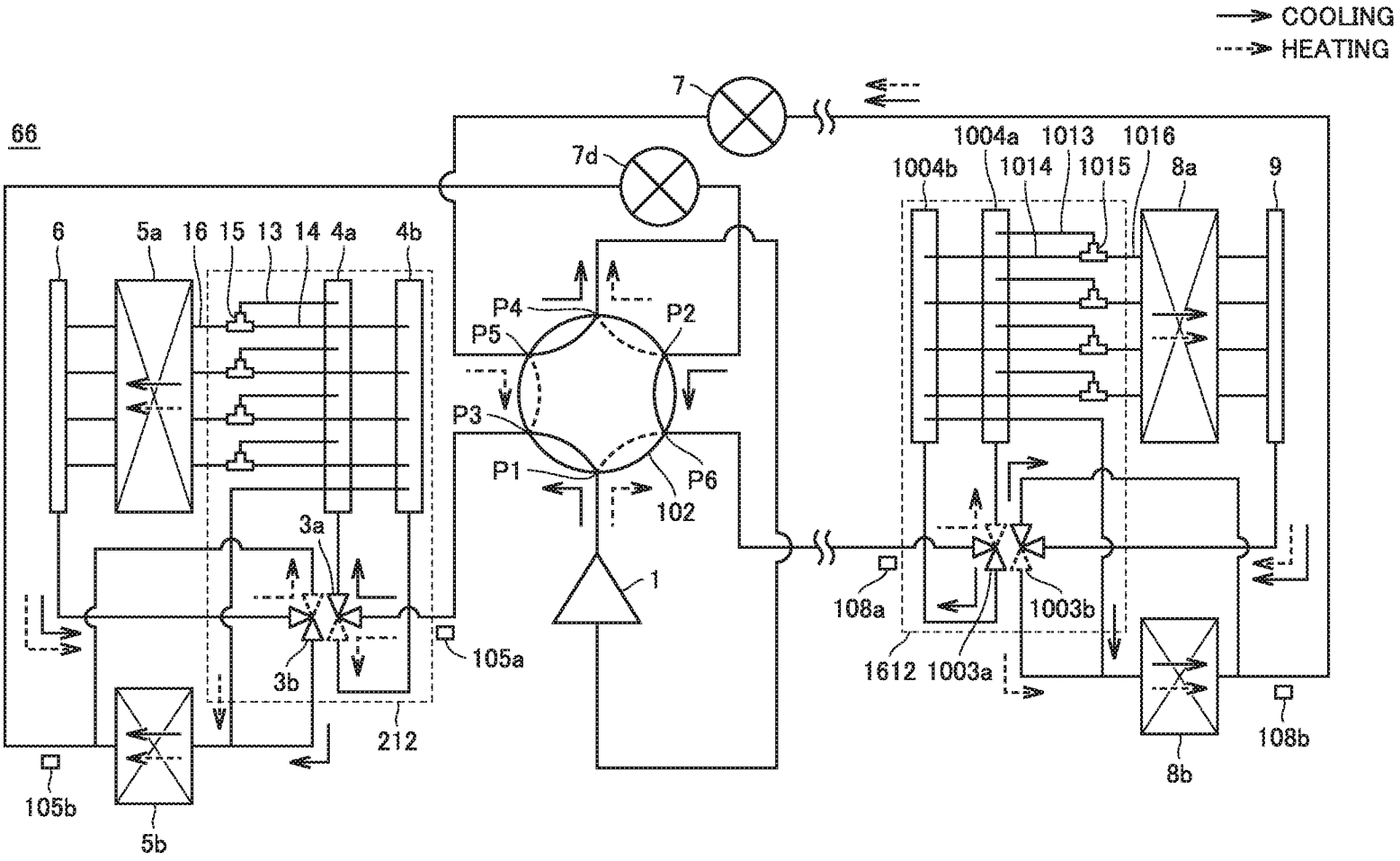
FIG. 29 is a block diagram showing a configuration of Modification 1 of a refrigeration cycle apparatus applicable to Embodiments 1 to 3.

With reference to FIG. 1 again, refrigeration cycle apparatus 50 according to Embodiment 1 includes a refrigeration circuit in which non-azeotropic refrigerant mixture circulates. The refrigeration circuit includes compressor 1, a first heat exchanger (outdoor heat exchanger 5), a second heat exchanger (indoor heat exchanger 8), expansion valve 7, and a multi-way valve. The multi-way valve is four-way valve 2 in one example, which may be a six-way valve as shown in FIG. 29 below. The multi-way valve is configured to assume a first state (cooling) and a second state (heating). In the first state (cooling), the non-azeotropic refrigerant mixture flows in order of the first heat exchanger (outdoor heat exchanger 5), expansion valve 7, and the second heat exchanger (indoor heat exchanger 8) in the refrigeration circuit. In the second state (heating), the non-azeotropic refrigerant mixture flows in order of the second heat exchanger (indoor heat exchanger 8), expansion valve 7, and the first heat exchanger (outdoor heat exchanger 5) in the refrigeration circuit. As shown in FIG. 2, the first heat exchanger (outdoor heat exchanger 5) includes refrigerant flow paths 10*a* and 10*b*, and the flow path switching device (linear flow path switching valve 12) configured to switch connections of refrigerant flow paths 10*a* and 10*b* between a series state in which the non-azeotropic refrigerant mixture flows through refrigerant flow paths 10*a* and 10*b* in series and a parallel state in which the non-azeotropic refrigerant mixture flows through refrigerant flow paths 10*a* and 10*b* in parallel. When the multi-way valve is in the second state (heating), controller 30 switches the flow path switching device (linear flow path switching valve 12) between the series state and the parallel state.

When the multi-way valve is in the cooling state, the flow path switching device (linear flow path switching valve 12) may be switched. In this case, it is intended to change a correspondence as follows: the first heat exchanger (indoor heat exchanger 8), the second heat exchanger (outdoor heat exchanger 5), the first state (heating), and the second state (cooling).

The operation of switching flow paths during heating can be described as follows. With reference to FIGS. 1 and 2, refrigeration cycle apparatus 50 includes the refrigeration circuit in which non-azeotropic refrigerant mixture circulates in order of compressor 1, the condenser (indoor heat exchanger 8), expansion valve 7, and the evaporator (outdoor heat exchanger 5), and controller 30. The evaporator includes flow paths 10*a* and 10*b*, and the flow path switching device (linear flow path switching valve 12) configured to switch connections of refrigerant flow paths 10*a* and 10*b* between the series state in which the non-azeotropic refrigerant mixture flows through refrigerant flow paths 10*a* and 10*b* in series and the parallel state in which the non-azeotropic refrigerant mixture flows through refrigerant flow paths 10*a* and 10*b* in parallel. Controller 30 switches the flow path switching device (linear flow path switching valve 12) between the series state and the parallel state during the operation (heating) of compressor 1 such that the non-azeotropic refrigerant mixture flows from expansion valve 7 to the evaporator (outdoor heat exchanger 5).

The flow path switching operation during cooling can be described as follows. Refrigeration cycle apparatus 50 includes the refrigeration circuit in which the non-azeotropic refrigerant mixture circulates in order of compressor 1, the condenser (outdoor heat exchanger 5), expansion valve 7, and the evaporator (indoor heat exchanger 8), and controller 30. The evaporator (indoor heat exchanger 8) includes refrigerant flow paths 10*a* and 10*b*, and the flow path switching device (linear flow path switching valve 12) configured to switch connections of refrigerant flow paths 10*a* and 10*b* between a series state in which the non-azeotropic refrigerant mixture flows through flow paths 10*a* and 10*b* in series and a parallel state in which the non-azeotropic refrigerant mixture flows through flow paths 10*a* and 10*b* in parallel. Controller 30 switches the flow path switching device (linear flow path switching valve 12) between the series state and the parallel state during the operation (cooling) of compressor 1 such that the non-azeotropic refrigerant mixture flows from expansion valve 7 to the evaporator (indoor heat exchanger 8).

When the heat exchanger of the evaporator is divided into two or more parts and the number of flow paths (path number) is changed by switching between series connection and parallel connection as shown in FIG. 2, the refrigerant temperature at the inlet of the evaporator tends to decrease as the path number increases, and the refrigerant temperature at the outlet of the evaporator tends to increase as the path number increases. This relationship will be described by showing a difference between normal refrigerant and non-azeotropic refrigerant mixture.

Figure 14:
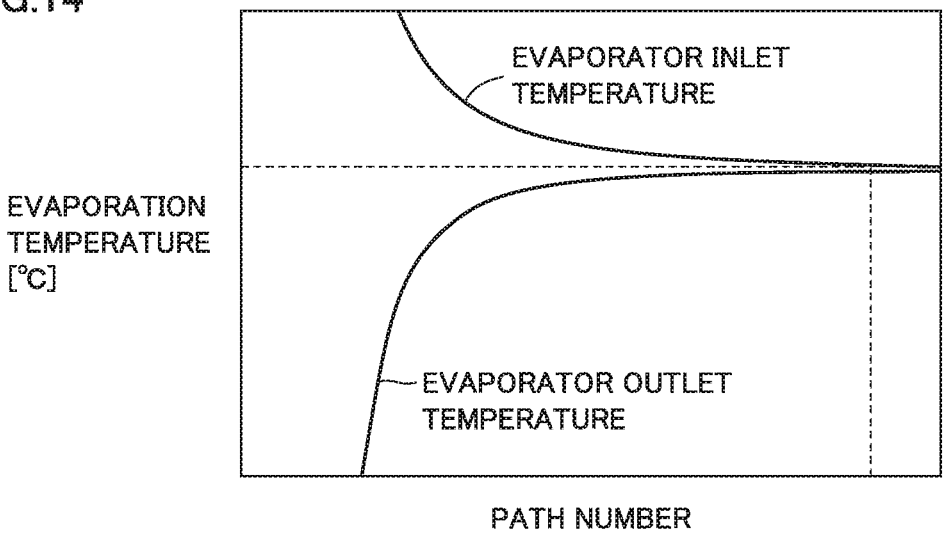
FIG. 14 shows a relationship between a refrigerant temperature at an inlet and a refrigerant temperature at an outlet of normal refrigerant (azeotropy) and the number of flow paths in an evaporator.
Figure 15:
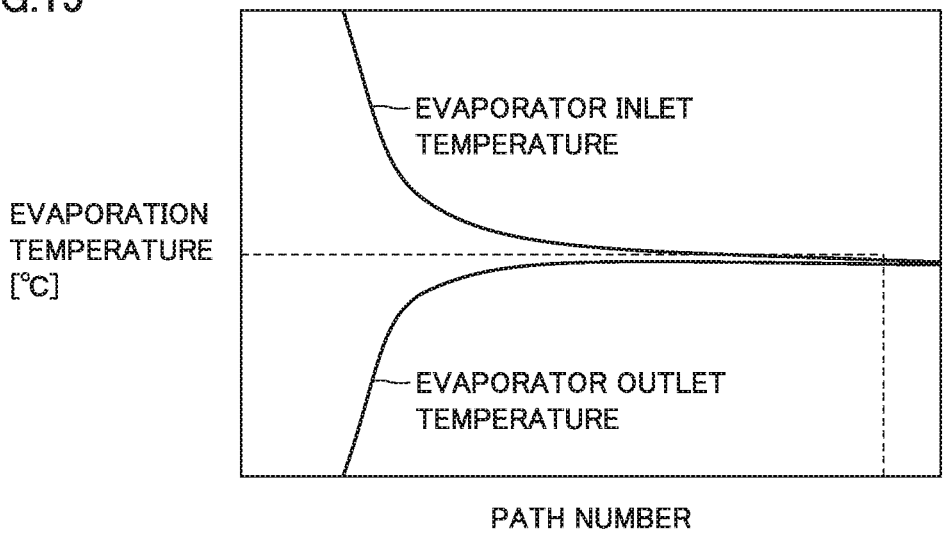
FIG. 15 shows a relationship between a refrigerant temperature at the inlet and a refrigerant temperature at the outlet of normal refrigerant (azeotropy) and the number of flow paths on varied operating conditions.

FIG. 14 shows a relationship between a refrigerant temperature at the inlet and a refrigerant temperature at the outlet of normal refrigerant (azeotropy) and the number of flow paths in the evaporator. FIG. 15 shows a relationship between a refrigerant temperature at the inlet and a refrigerant temperature at the outlet of normal refrigerant (azeotropy) and the number of flow paths in the evaporator on varied operating conditions.

As shown in FIG. 3, conventional refrigerant (e.g., R32) has almost no "temperature glide". Thus, as shown in FIG. 14, increasing the path number reduces a pressure loss to reduce a temperature difference between the inlet and the outlet, but the temperature at the inlet and the temperature at the outlet will not be reversed. A path number (indicated by the vertical broken line in FIG. 14) by which the temperature difference between the inlet and the outlet is almost balanced is used as an optimum path number. The temperature at the inlet will not be lower than the temperature at the outlet even when the path number exceeds the optimum path number. This relationship will not change also in the case of FIG. 15 in which the evaporation temperature decreases due to a change in operating situation.

Figure 16:
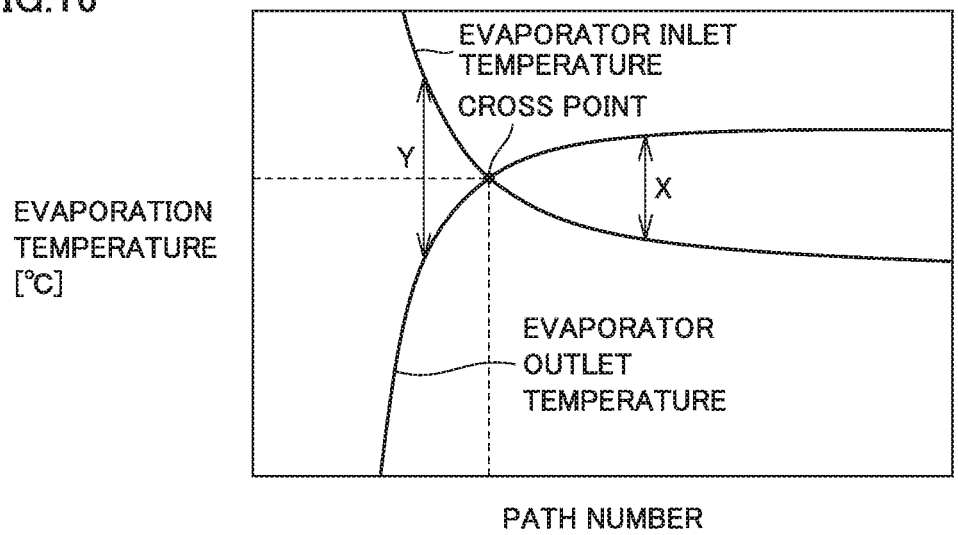
FIG. 16 shows a relationship between a refrigerant temperature at the inlet and a refrigerant temperature at the outlet of non-azeotropic refrigerant mixture and the number of flow paths in an evaporator.
Figure 17:
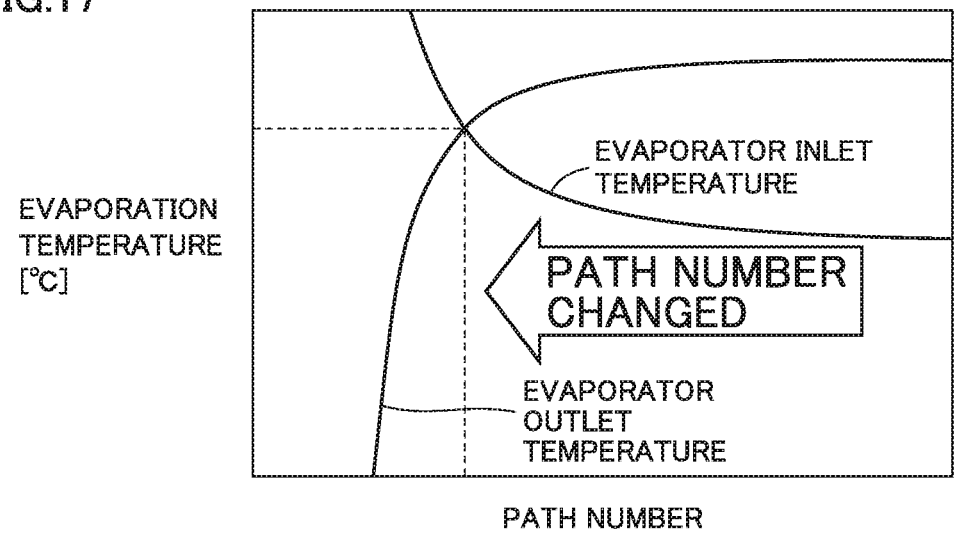
FIG. 17 shows a relationship between a refrigerant temperature at the inlet and a refrigerant temperature at the outlet of non-azeotropic refrigerant mixture and the number of flow paths on varied operating conditions.

FIG. 16 shows a relationship between a refrigerant temperature at the inlet and a refrigerant temperature at the outlet of non-azeotropic refrigerant mixture and the number of flow paths in the evaporator. FIG. 17 shows a relationship between a refrigerant temperature at the inlet and a refrigerant temperature at the outlet of non-azeotropic refrigerant mixture and the number of flow paths in the evaporator on varied operating conditions.

As shown in FIG. 4, non-azeotropic refrigerant mixture has a temperature glide. At the same pressure, the evaporator tends to have a higher temperature as the temperature on the gas side (outlet side) becomes higher. As pressure loss decreases by increasing the path number, the temperature at the inlet (e.g., 10° C.) is lower than the temperature at the outlet (e.g., 15° C.). The non-azeotropic refrigerant mixture thus has a cross point (see FIG. 16) at which the temperature at the outlet and the temperature at the inlet are reversed.

For azeotropy refrigerant, the temperature difference between the inlet and outlet can be reduced by increasing the path number. For non-azeotropic refrigerant mixture, however, the temperature on the inlet side becomes lower than the temperature on the outlet side by increasing the path number, causing partial frost formation or partial dew condensation.

Although it suffices that an evaporator is configured such that pressure loss matches temperature gradient on a specific condition alone, pressure loss or the like changes depending on operating conditions, and the path number at which a cross point is provided changes. In the present embodiment, thus, the path number is changed in accordance with an operating situation or surrounding environment so as to reduce the temperature difference between the inlet and the outlet (provide a cross point), thereby forming a refrigeration circuit appropriate for the operating situation.

In actuality, however, the path number cannot be changed steplessly, so that a path number closest to the cross point is selected. A temperature difference between the refrigerant inlet and the refrigerant outlet can be used as a parameter indicative of closeness to the cross point. A point with a temperature difference of zero is a cross point, and it can be determined that the path number is closer to the cross point as the temperature difference is closer to zero.

The present embodiment is characterized in that controller 30 switches linear flow path switching valve 12 to reduce an inlet-outlet temperature difference based on an output of the temperature sensor that detects an inlet-outlet refrigerant temperature difference of the evaporator.

The number of flow paths closer to the cross point can be selected by switching linear flow path switching valve 12. Partial dew condensation or partial frost formation can be prevented by selecting a form in which the number of flow paths is close to the cross point. Preventing partial dew condensation can prevent dew scattering and also allows the use of a heat exchanger at high efficiency. Preventing partial frost formation can increase a continuous operation time that is not interrupted by a defrosting operation. Also, the heat exchanger can be used at a lower temperature in the operating range (this is because, though defrosting is started when frost formation occurs in large quantities in part of the heat exchanger, more uniform frost formation makes it difficult to cause frost formation even in the use on a lower-temperature side).

Various operating states of the refrigeration cycle apparatus and refrigerant flow directions will now be described with reference to FIGS. 18 to 20.

Figure 18:
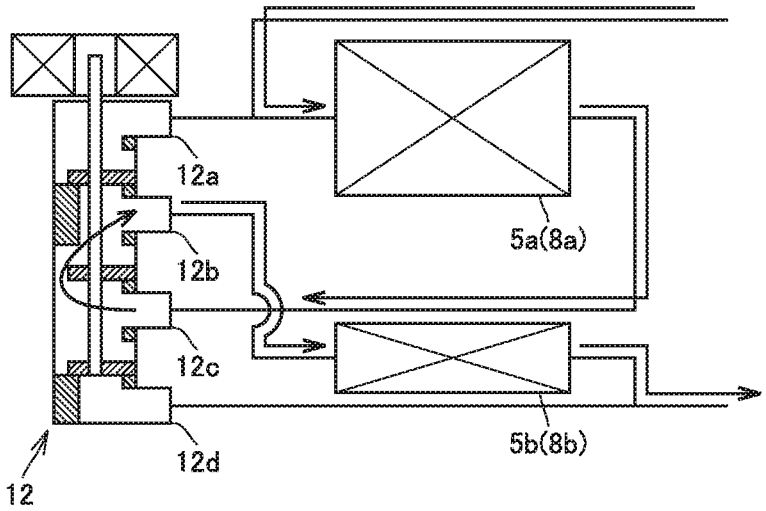
FIG. 18 shows a flow of refrigerant in a heat exchanger during condensation in the present embodiment.

FIG. 18 shows a flow of refrigerant in the heat exchanger during condensation in the present embodiment. When outdoor heat exchanger 5 (or indoor heat exchanger 8) is used as a condenser, in the present embodiment, the refrigerant that has flowed from a refrigerant inlet passes through heat exchange unit 5*a* (8*a*), passes through ports 12*c* and port 12*b* of linear flow path switching valve 12 and then heat exchange unit 5*b* (8*b*), to be discharged from a refrigerant outlet. Since ports 12*a* and 12*d* are closed by the valve main body of linear flow path switching valve 12, refrigerant does not flow therethrough.

Figure 19:
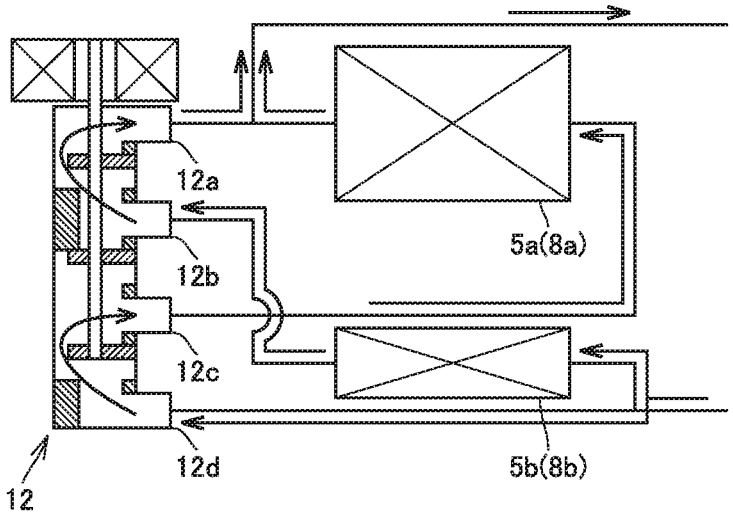
FIG. 19 shows a flow of refrigerant in the heat exchanger during evaporation and during selection of a type with a large number of flow paths in the present embodiment.

FIG. 19 shows a flow of refrigerant in the heat exchanger during evaporation and during selection of a form with a large number of flow paths in the present embodiment. When outdoor heat exchanger 5 (or indoor heat exchanger 8) is used as an evaporator and when the form with a large number of flow paths is selected, in the present embodiment, part of the refrigerant that has flowed from the refrigerant inlet passes through heat exchange unit 5*b* (8*b*), and subsequently passes through ports 12*b* and 12*a*, to be discharged from the refrigerant outlet. As to the rest of the refrigerant that has flowed from the refrigerant inlet, the refrigerant that has flowed through ports 12*d* and 12*c* and then passed through heat exchange unit 5*a* (8*a*) flows out from the refrigerant outlet. In this form, refrigerant flows through heat exchange unit 5*a* (8*a*) and heat exchange unit 5*b* (8*b*) in parallel.

Figure 20:
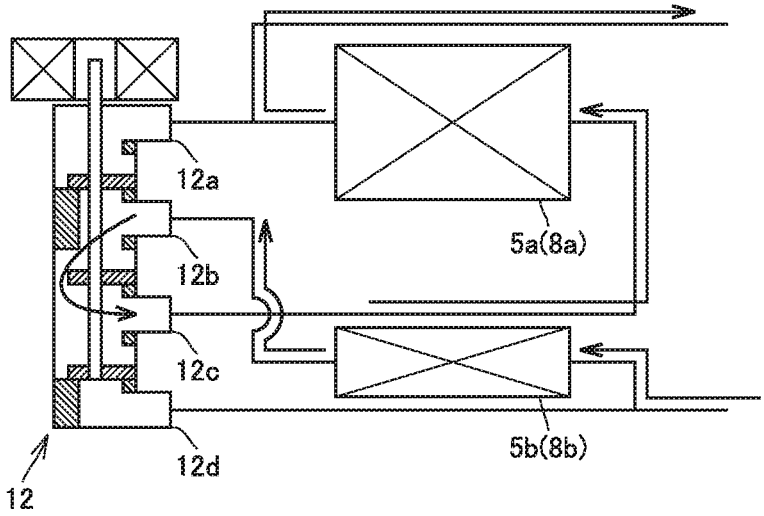
FIG. 20 shows a flow of refrigerant in the heat exchanger during evaporation and during selection of a type with a small number of flow paths in the present embodiment.

FIG. 20 shows a flow of refrigerant in the heat exchanger during evaporation and during selection of a form with a small number of flow paths in the present embodiment. When outdoor heat exchanger 5 (or indoor heat exchanger 8) is used as an evaporator and a form with a small number of flow paths is selected, in the present embodiment, the refrigerant that has flowed from the refrigerant inlet passes through heat exchange unit 5*b* (8*b*), passes through ports 12*b* and port 12*c* of linear flow path switching valve 12, and then passes through heat exchange unit 5*a* (8*a*), to be flowed from the refrigerant outlet. Since ports 12*a* and 12*d* are closed by the valve main body of linear flow path switching valve 12, refrigerant does not flow therethrough.

The use of the linear flow path switching valve shown in FIGS. 18 to 20 makes the number of flow paths variable during cooling and during heating. Further, also during heating, the number of flow paths can be changed depending on how the refrigeration cycle apparatus is operated. It is more preferable that switching at this time be made closer to the cross point of the inlet-outlet temperature of the evaporator. As shown in FIG. 1, providing temperature sensors 105*a*, 105*b*,108*a*, and 108*b* to the inlet and the outlet of the heat exchanger can detect a temperature difference and enables selection of a form closer to a cross point at which a temperature difference is small.

Figure 21:
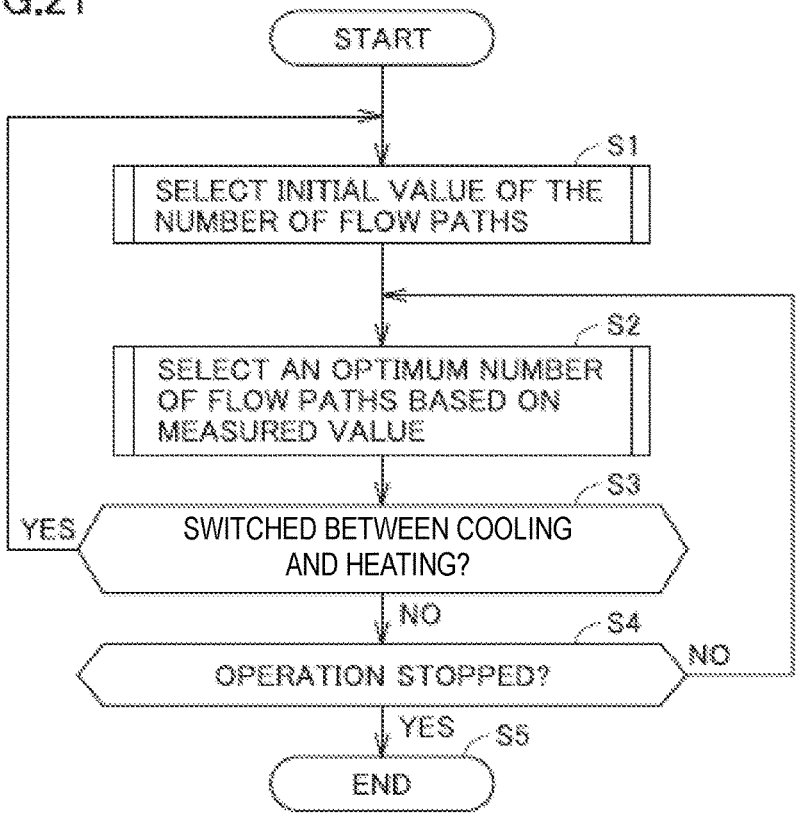
FIG. 21 is a flowchart showing a main routine of control of selecting the number of flow paths of a heat exchanger in the present embodiment.

FIG. 21 is a flowchart showing a main routine of control of selecting the number of flow paths of the heat exchanger in the present embodiment. With reference to FIG. 21, at step S1, controller 30 first selects an initial value of the number of flow paths depending on whether the operation is heating or cooling. At step S2, controller 30 subsequently selects an optimum number of flow paths of the evaporator based on the measured value of temperature, power, or the like.

At step S3, subsequently, the presence or absence of switching between cooling and heating is determined. When switching between cooling and heating has been made at step S3 (YES at S3), the process returns to step S1 again. When switching between cooling and heating has not been made at step S3 (NO at S3), the process proceeds to step S4.

At step S4, controller 30 determines whether an operation stop instruction has been provided by a stop button, a timer, or the like. When the operation stop instruction has been provided, the process proceeds from step S4 to step S5, so that the refrigeration cycle apparatus stops operation. In contrast, when the operation stop instruction has not been provided, the process returns from step S4 to step S2, so that the process of selecting an optimum number of flow paths based on a measured value is performed again.

Figure 22:
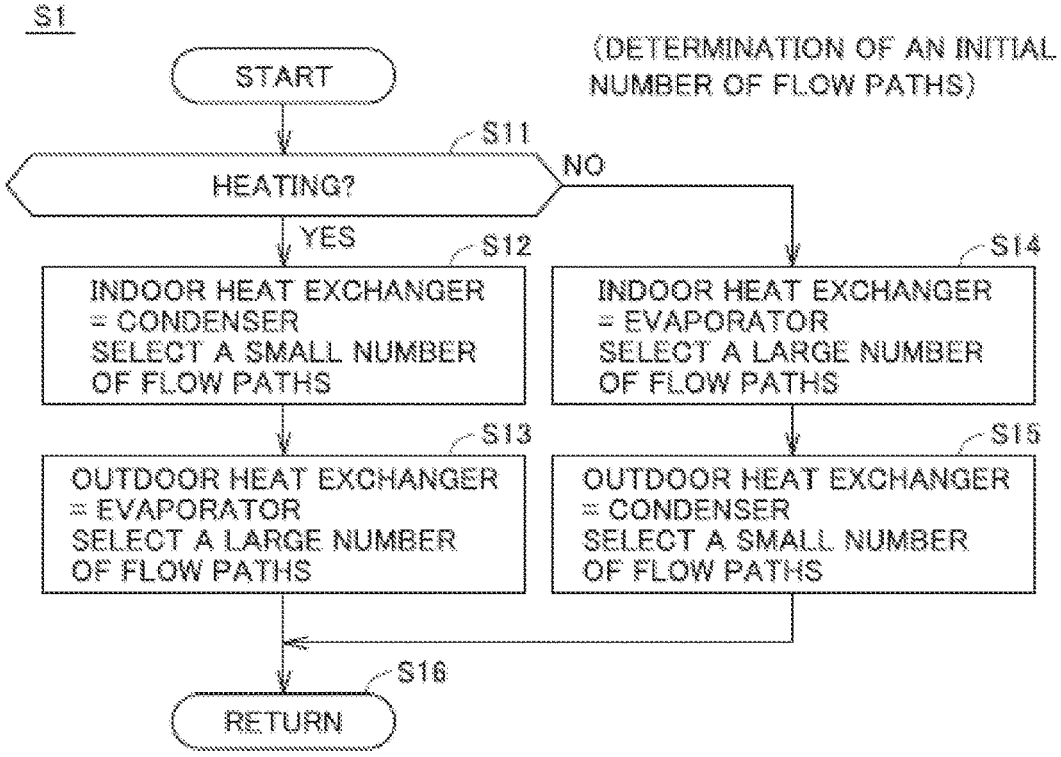
FIG. 22 is a flowchart showing details of a process of step S1 in FIG. 21.

FIG. 22 is a flowchart showing details of the process of step S1 in FIG. 21. With reference to FIG. 22, when it is determined that heating operation is currently performed at step S11 (YES at S11), a small number of flow paths are selected for the indoor heat exchanger operating as a condenser at step S12. Specifically, as shown in FIG. 18, heat exchange units 8*a* and 8*b* of indoor heat exchanger 8 are connected in series, and linear flow path switching valve 12 of indoor heat exchanger 8 is switched to cause refrigerant to flow therethrough in the stated order. At step S13, a large number of flow paths are selected for outdoor heat exchanger 5 operating as an evaporator. Specifically, as shown in FIG. 19, heat exchange units 5*a* and 5*b* of outdoor heat exchanger 5 are connected in parallel, and linear flow path switching valve 12 of outdoor heat exchanger 5 is switched to cause refrigerant to flow therethrough in parallel.

When the operation is not heating at step S11 (NO at step S11, during cooling), the process proceeds to step S14. At step S14, a large number of flow paths are selected for indoor heat exchanger 8 operating as the evaporator. Specifically, as shown in FIG. 19, heat exchange units 8*a* and 8*b* of indoor heat exchanger 8 are connected in parallel, and linear flow path switching valve 12 of indoor heat exchanger 8 is switched to cause refrigerant to flow therethrough in parallel. At step S15, a small number of flow paths are selected for the outdoor heat exchanger operating as a condenser. Specifically, as shown in FIG. 18, heat exchange units 5*a* and 5*b* of outdoor heat exchanger 5 are connected in series, and linear flow path switching valve 12 of outdoor heat exchanger 5 is switched to cause refrigerant to flow therethrough in the stated order.

After completion of the initial setting of the number of flow paths at steps S12 and S13 or steps S14 and S15, at step S16, control is returned to the flowchart of FIG. 21 to perform the process of step S2.

Figure 23:
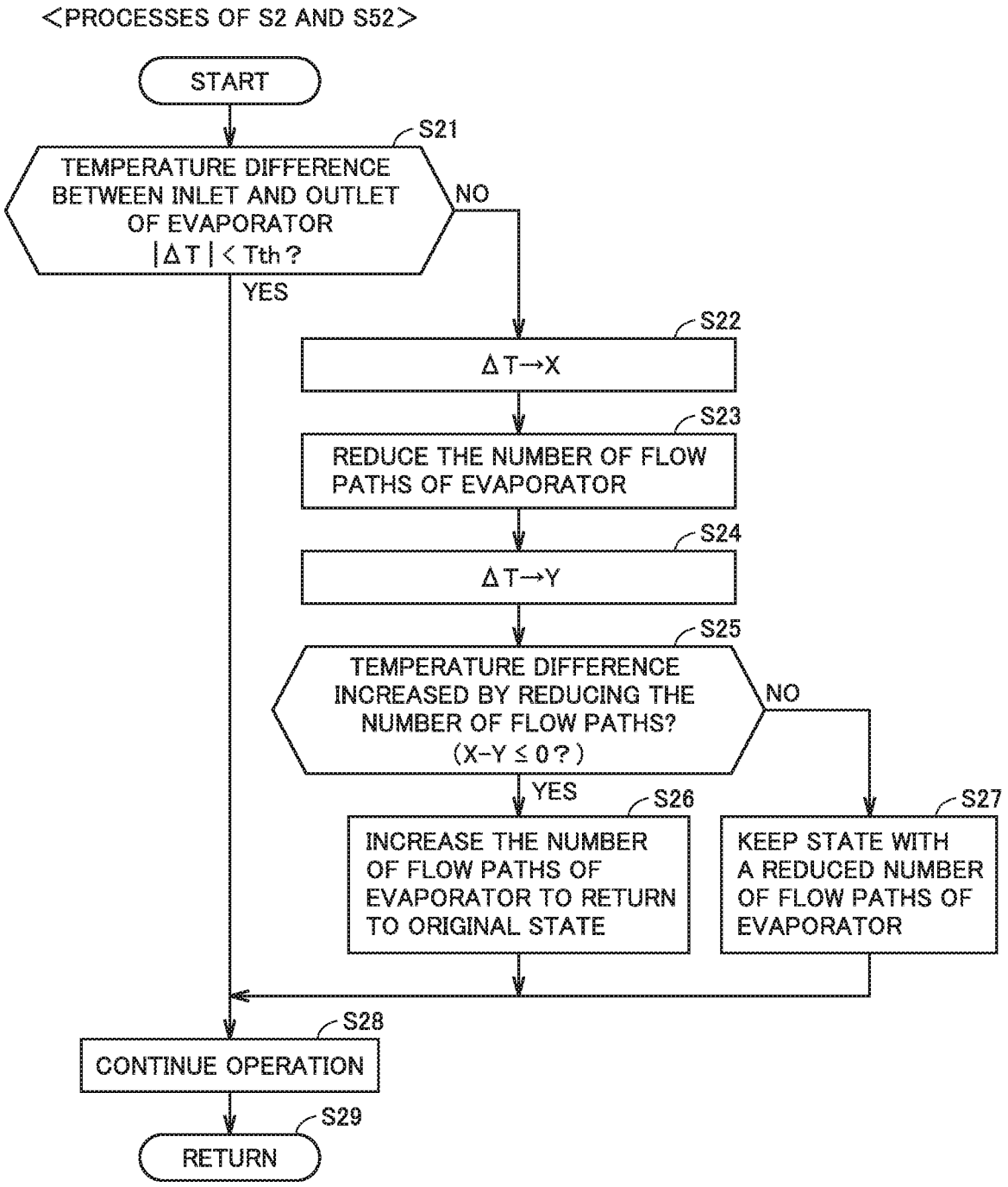
FIG. 23 is a flowchart showing details of a process of step S2 in FIG. 21.

FIG. 23 is a flowchart showing details of the process of step S2 in FIG. 21. At step S21, controller 30 first calculates an inlet-outlet temperature difference $\Delta T$ of the evaporator from the values measured by temperature sensors 105*a* and 105*b* or temperature sensors 108*a* and 108*b* after a lapse of a predetermined period of time from the initial setting, and then determines whether magnitude $|\Delta T|$ thereof is smaller than a threshold Tth. Threshold Tth is a determination value for determining that $\Delta T$ is nearly zero.

When $|\Delta T|<Tth$ is satisfied at step S21 (YES at S21), the number of flow paths of the evaporator is an optimum number, and the evaporator operates in a state closer to the cross point in FIG. 16. This does not require changing the number of flow paths of the evaporator, and accordingly, the process proceeds to step S28, so that the operation is continued in this state.

When $|\Delta T|<Tth$ is not satisfied at step S21 (NO at S21), the number of flow paths of the evaporator may not be an optimum number. Thus, the processes of step S22 and the following steps are performed in order to determine whether change of the number of flow paths of the evaporator is required.

At step S22, controller 30 first stores a temperature difference ΔT calculated at step S21 as a temperature difference X. At step S23, controller 30 then switches linear switching valve 12 to reduce the number of flow paths of the evaporator. Refrigerant consequently flows through the evaporator from the state shown in FIG. 19 to the state shown in FIG. 20. After a lapse of a predetermined period of time, at step S24, controller 30 calculates temperature difference ΔT from the values measured by temperature sensors 105*a* and 105*b* or temperature sensors 108*a* and 108*b*, and stores the calculated value as a temperature difference Y.

At step S25, controller 30 then determines whether the temperature difference has increased by reducing the number of flow paths. When $X-Y\leq 0$ is satisfied at step S25, that is, when ΔT has increased, controller 30 returns linear flow path switching valve 12 to the setting with a large number of flow paths (step S26). Contrastingly, when $X-Y\leq 0$ is not satisfied, that is, when ΔT has decreased, controller 30 keeps linear flow path switching valve 12 at the setting with a small number of flow paths (step S27).

As described above, refrigeration cycle apparatus 50 includes controller 30 that controls linear flow path switching valve 12 as shown in FIG. 23. When changing the connections of refrigerant flow paths 10*a* and 10*b*, controller 30 maintains a connection state after the change if the temperature difference between the refrigerant temperature at the inlet and the refrigerant temperature at the outlet of the evaporator has reduced, and returns the connection state after the change to the original state when the temperature difference has increased.

The number of flow paths is temporarily changed, and the number of flow paths to be used is determined based on how the temperature difference between the temperature at the inlet and the temperature at the outlet of the evaporator changes, as described above. This enables selection of a flow path to reduce a temperature difference between the inlet and the outlet during evaporation depending on the composition of the non-azeotropic refrigerant mixture or operating state.

With the selected number of flow paths, the operation is continued at step S28, and the control is shifted to step S3 of FIG. 21 at step S29.

The above control can reduce temperature difference ΔT, thereby suppressing the occurrence of partial frost formation and partial dew condensation.

Embodiment 2

Figure 24:
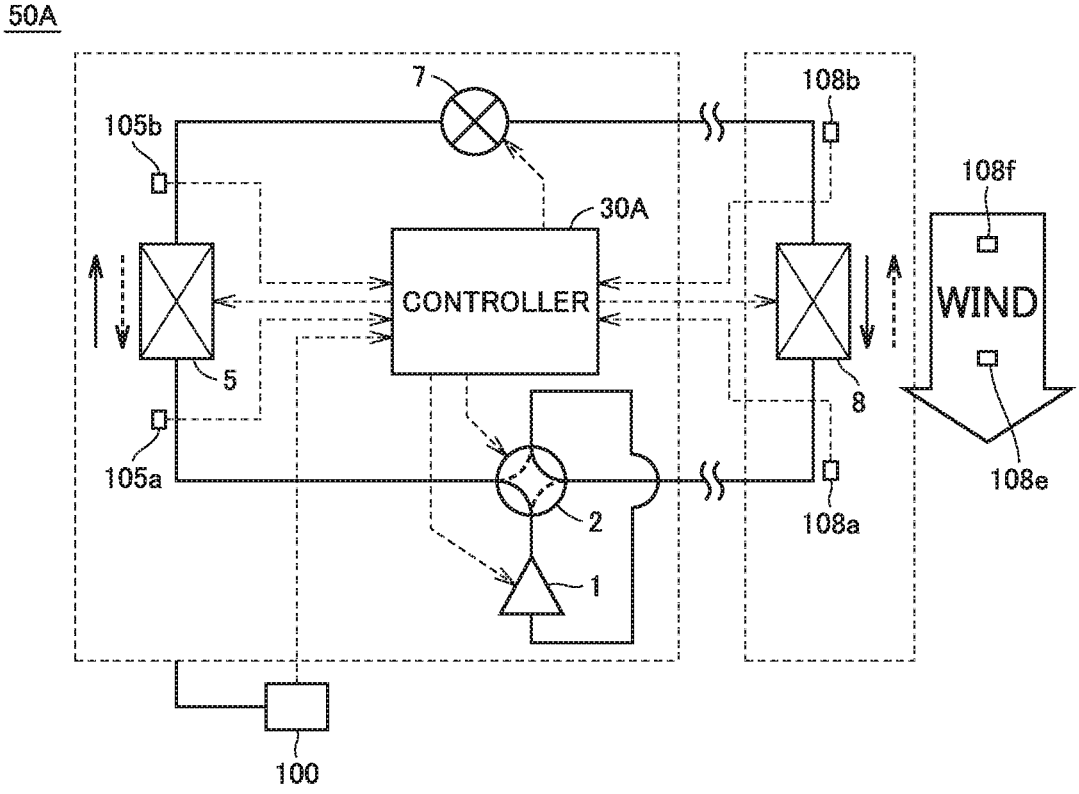
FIG. 24 is a block diagram showing a configuration of a refrigeration cycle apparatus of Embodiment 2.

FIG. 24 is a block diagram showing a configuration of a refrigeration cycle apparatus of Embodiment 2. A refrigeration cycle apparatus 50A shown in FIG. 24 is similar to refrigeration cycle apparatus 50 of Embodiment 1 in basic configuration and further includes a temperature sensor 108*f* that detects an inlet temperature on the indoor side, a temperature sensor 108*e* that detects an outlet temperature, and a wattmeter 100, in addition to temperature sensors 105*a*, 105*b*, 108*a*, and 108*b*. Refrigeration cycle apparatus 50A includes a controller 30A in place of controller 30. Controller 30A switches linear flow path switching valve 12 of the evaporator based on the results detected by temperature sensors 105*a*, 105*b*, 108*a*, 108*b*, 108*e*, and 108*f* and the result detected by wattmeter 100.

Wattmeter 100 may be a common wattmeter capable of measuring electric power or a wattmeter that computes electric power from frequency, set temperature, and indoor and outdoor temperatures. For example, a table capable of computing electric power from operation frequency, set temperature, indoor temperature, and outdoor temperature may be provided in advance as means for detecting electric power.

Refrigeration cycle apparatus 50A of Embodiment 2 uses non-azeotropic refrigerant mixture as refrigerant and includes compressor 1, four-way valve 2, outdoor heat exchanger 5, expansion valve 7, indoor heat exchanger 8, linear flow path switching valves 12 respectively provided in outdoor heat exchanger 5 and indoor heat exchanger 8, temperature sensors 105*a*, 105*b*, 108*a*, 108*b*, 108*f*, and 108*e*, wattmeter 100, and controller 30A. Controller 30A is characterized by switching linear flow path switching valve 12 based on the result of the temperature detected by the temperature sensor and the result of the electric power detected by the wattmeter and further switching linear flow path switching valve 12 to reduce power consumption (maximize COP) in equal-capability output.

Figure 25:
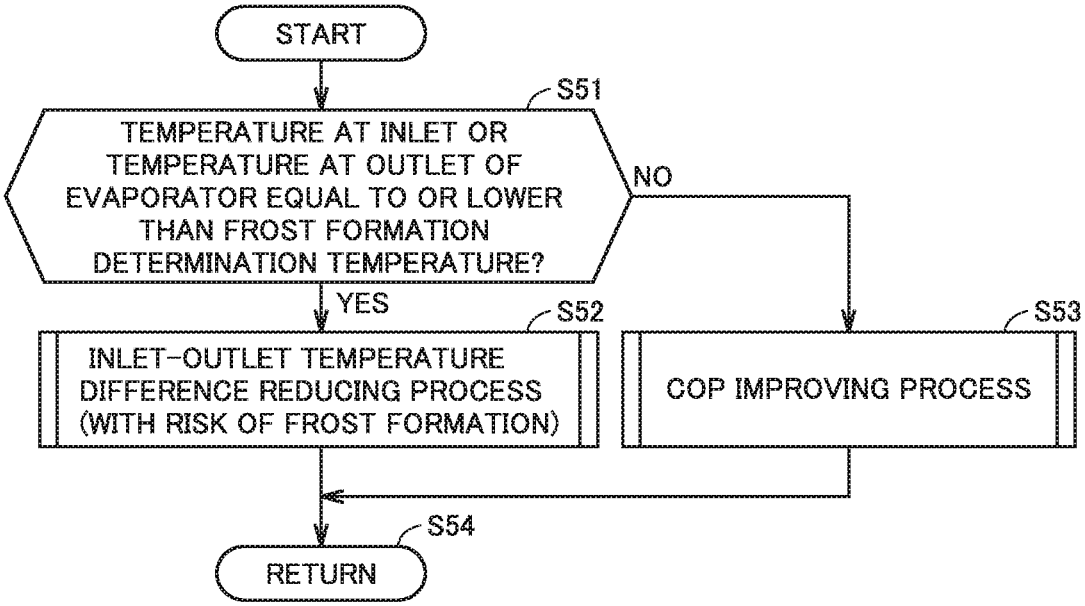
FIG. 25 is a flowchart for illustrating a process of selecting the number of flow paths in Embodiment 2.

Although the main routine in Embodiment 2 is also similar to that of FIG. 21, step S2A is performed in place of step S2. FIG. 25 is a flowchart for illustrating a process of selecting the number of flow paths in Embodiment 2. At step S51 of FIG. 25, the result of the temperature detected by temperature sensors 105*a* and 105*b* or temperature sensors 108*a* and 108*b* that detect the temperatures at the inlet and outlet of the evaporator is compared with a frost formation determination temperature (e.g., 0° C.), and whether there is a risk of frost formation in the evaporator is determined.

At step S51, if there is a risk of frost formation (YES at S51), the process proceeds to step S52, so that controller 30A performs a process of reducing an inlet-outlet temperature difference. The process of step S52 is similar to the process of step S2 described with reference to FIG. 23. Description of the process of step S52 will thus not be repeated.

Contrastingly, if there is no risk of frost formation at step S51 (NO at S51), the process proceeds to step S53, so that controller 30A performs a process of improving COP of the refrigeration cycle apparatus.

That is to say, as shown in FIG. 25, controller 30A is configured to, when both the refrigerant temperature at the inlet and the refrigerant temperature at the outlet of the evaporator are higher than the frost formation determination temperature, change the connections of refrigerant flow paths 10*a* and 10*b* to change the number of flow paths, thereby increasing the coefficient of performance of the refrigeration cycle apparatus.

Figure 26:
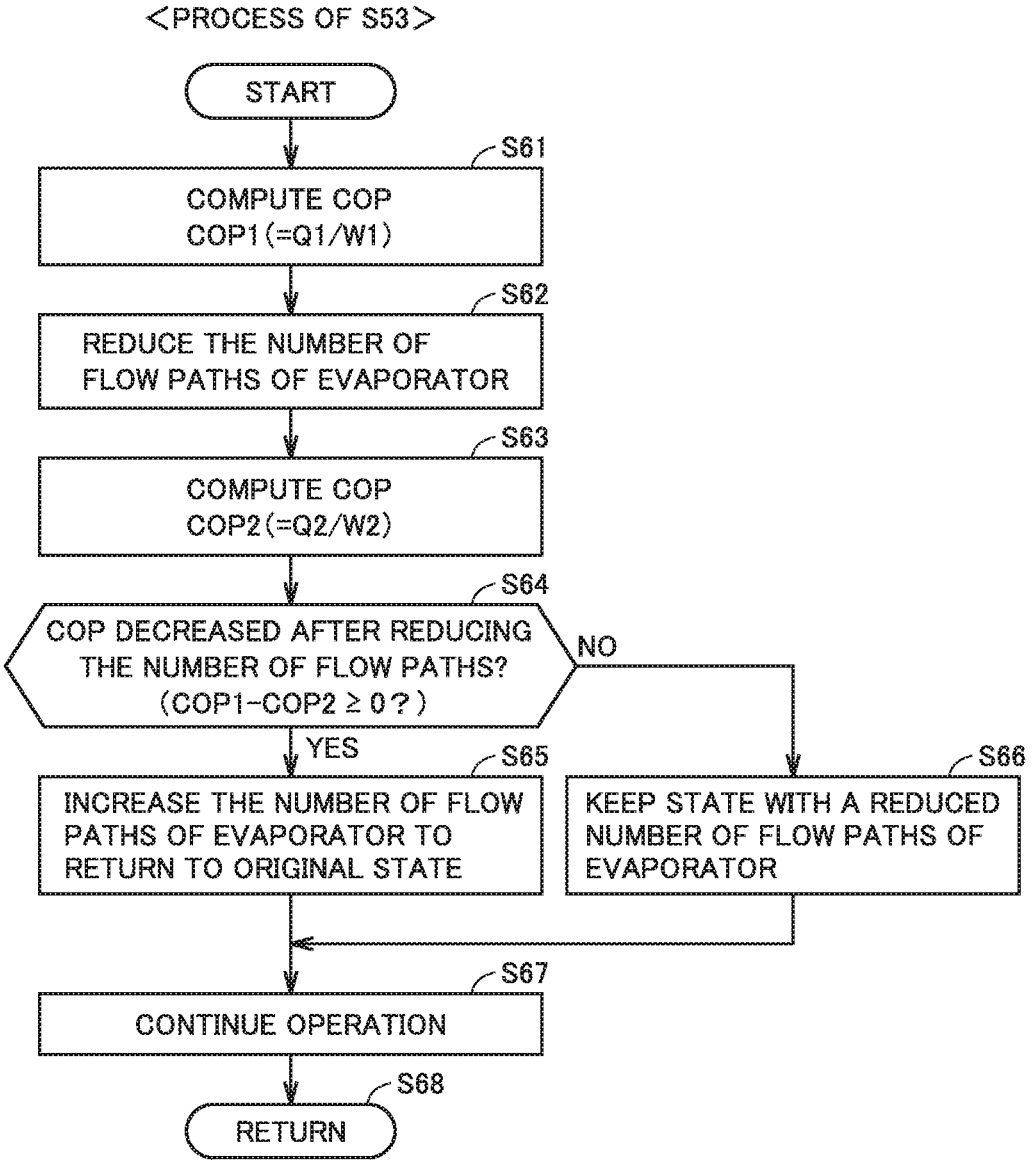
FIG. 26 is a flowchart showing details of a process of improving COP performed at step S53 in FIG. 25.

FIG. 26 is a flowchart showing details of the process of improving COP which is performed at step S53 of FIG. 25. First, at step S61, an air mass flow rate Ga is calculated from a volume of air Qa computed from the number of rotations of an indoor fan, an air density ρ, an inlet temperature T1 computed by an inlet temperature detection sensor, and an outlet temperature T2, and a heating capability Q1 is calculated using the calculated air mass flow rate Ga.

$$Ga=Qa\times\rho$$

$$Q1=Ga\times Cp\times(T1-T2)$$

Then, COP1 (=Q1/W1) is calculated from the calculated heating capability Q1 and power consumption W obtained from the wattmeter.

Subsequently, at step S62, linear flow path switching valve 12 on the evaporator side is switched, and at step S63, COP2 is calculated from Q2=Ga×Cp×(T1−T2) and COP2=Q2/W2 by a way similar to that of step S61 after a lapse of a predetermined period of time.

At step S64, controller 30A determines whether COP has decreased. If COP1≥COP2 at step S64 (YES at S64), controller 30A switches linear flow path switching valve 12 and returns the number of flow paths to the original number. If COP1<COP2 at step S64 (NO at S64), controller 30A keeps linear flow path switching valve 12 at the current state, the state with a reduced number of flow paths.

When the number of flow paths is determined at step S65 or S66, controller 30A determines to continue operation at step S67, and then at step S68, returns control to the main routine of FIG. 21.

Refrigeration cycle apparatus 50A according to Embodiment 2 includes wattmeter 100 that detects the power consumption of refrigeration cycle apparatus 50A. As shown in FIG. 24, when changing the connections of refrigerant flow paths 10*a* and 10*b*, controller 30A maintains a connection state after the change (S66) if the coefficient of performance calculated based on a value measured by wattmeter 100 is higher than that before changing the connections (NO at S64) and returns the connection state after the change to the original state (S65) if the coefficient of performance has decreased (YES at S64).

The refrigeration cycle apparatus according to Embodiment 2 described above determines the presence or absence of a risk of frost formation, and accordingly, can prevent partial frost formation. In addition, an operation of reducing power consumption further can be performed in the operation range free from frost formation. Consequently, power consumption can be reduced in equal-capability output. Moreover, COP can be improved.

Embodiment 3

Figure 27:
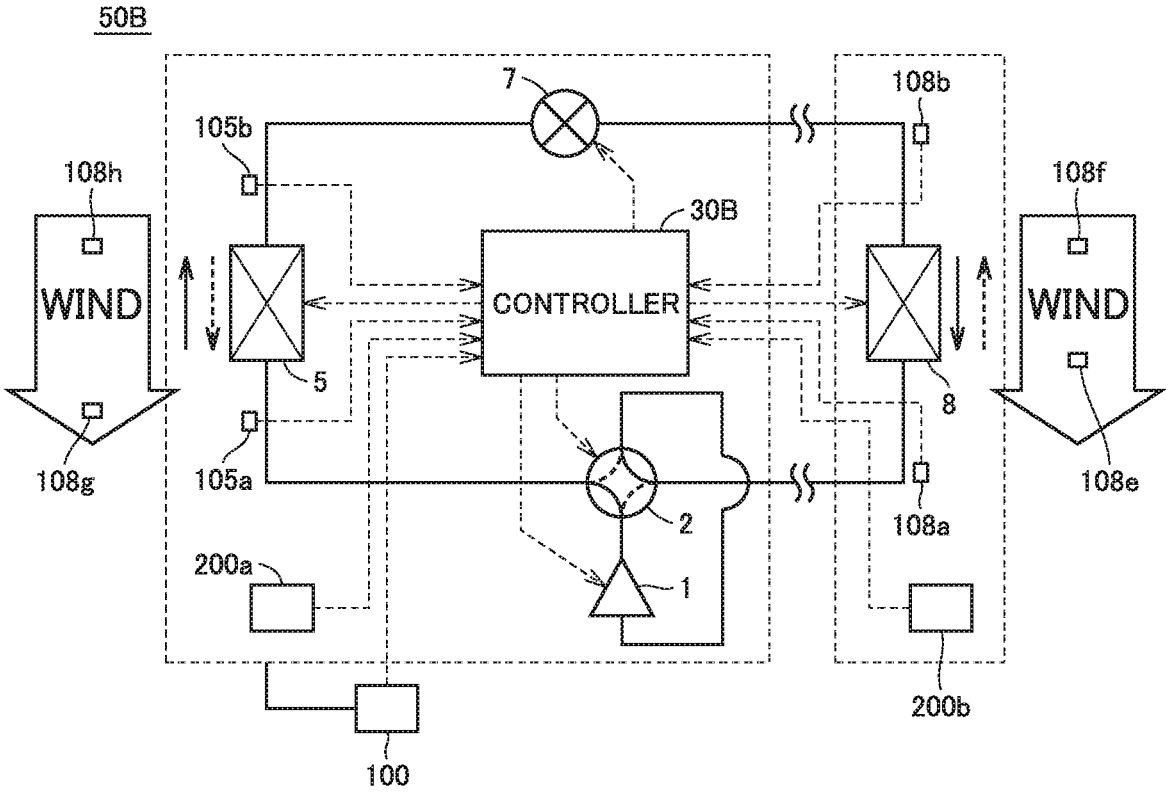
FIG. 27 is a block diagram showing a configuration of a refrigeration cycle apparatus of Embodiment 3.

FIG. 27 is a block diagram showing a configuration of a refrigeration cycle apparatus of Embodiment 3. A refrigeration cycle apparatus 50B shown in FIG. 27 is similar to refrigeration cycle apparatus 50A of Embodiment 2 in basic configuration and further includes a temperature sensor 108*h* that detects an inlet temperature on the outdoor side, a temperature sensor 108*g* that detects an outlet temperature, and humidity sensors 200*a* and 200*b*, in addition to temperature sensors 105*a*, 105*b*, 108*a*, 108*b*, 108*e*, and 108*f*. Refrigeration cycle apparatus 50B also includes a controller 30B in place of controller 30A. Controller 30B switches linear flow path switching valve 12 of the evaporator based on the results detected by temperature sensors 105*a*, 105*b*, 108*a*, 108*b*, 108*e*, 108*f*, 108*g*, and 108*h* and the results detected by wattmeter 100 and humidity sensors 200*a* and 200*b*.

Refrigeration cycle apparatus 50B of Embodiment 3 uses non-azeotropic refrigerant mixture as refrigerant and includes compressor 1, four-way valve 2, outdoor heat exchanger 5, expansion valve 7, indoor heat exchanger 8, linear flow path switching valves 12 respectively provided in outdoor heat exchanger 5 and indoor heat exchanger 8, temperature sensors 105*a*, 105*b*, 108*a*, 108*b*, 108*f*, and 108*e*, wattmeter 100, humidity sensors 200*a* and 200*b*, and controller 30B. Controller 30B is characterized by switching linear flow path switching valve 12 based on the result of the temperature detected by the temperature sensor, the result of the electric power detected by the wattmeter, and the result detected by the humidity sensor, and further switching linear flow path switching valve 12 to reduce power consumption (maximize COP) in equal-capability output.

Figure 28:
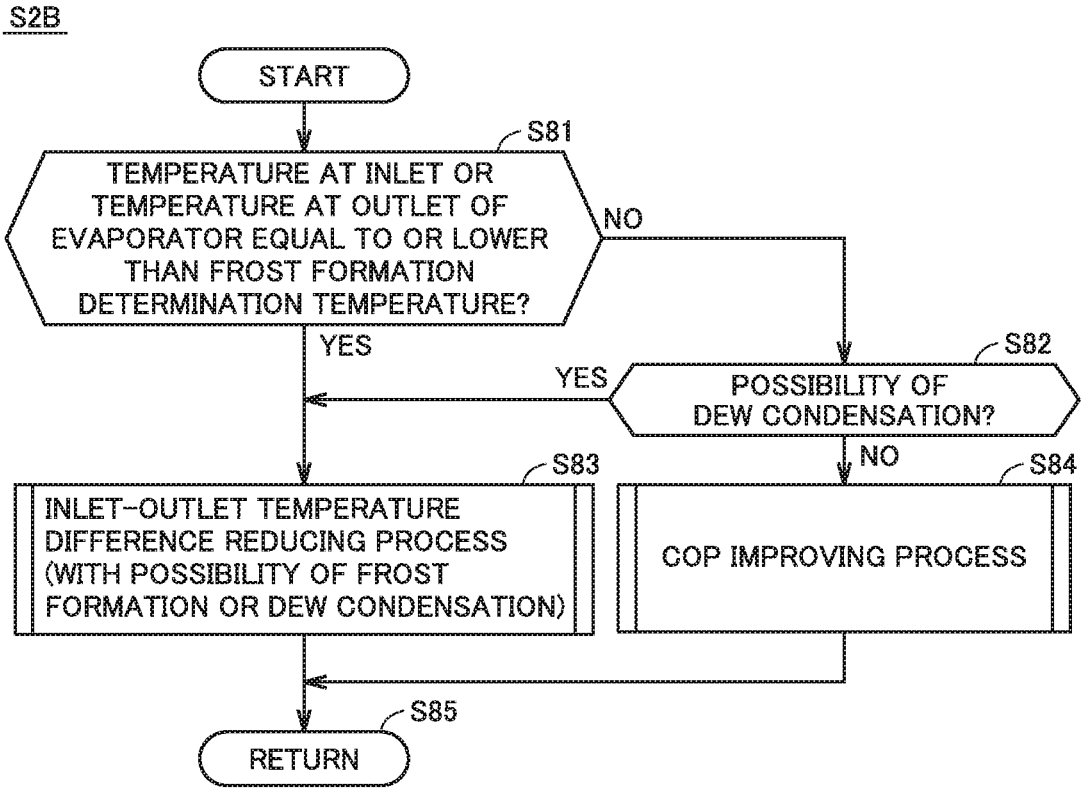
FIG. 28 is a flowchart for illustrating a process of selecting the number of flow paths in Embodiment 3.

Although the main routine in Embodiment 3 is similar to that of FIG. 21, step S2B is performed in place of step S2. FIG. 28 is a flowchart for illustrating the process of selecting the number of flow paths in Embodiment 3. At step S81 of FIG. 28, the result of the temperature detected by temperature sensors 105*a* and 105*b* or temperature sensors 108*a* and 108*b* that detect the temperatures at the inlet and outlet of the evaporator is compared with a frost formation determination temperature (e.g., 0° C.), and whether there is a risk of frost formation in the evaporator is determined.

If there is no risk of frost formation at step S81 (NO at S81), the process proceeds to step S82, and whether there is a risk of dew condensation is determined. At step S82, various determinations can be made depending on a humidity sensor that is used. For example, at step S82, temperature and humidity are detected using the air intake temperature and the humidity sensor, and a dew point temperature Tsat is computed based on the detected result. Then, an air intake enthalpy, a saturation enthalpy, and an outlet enthalpy are computed from the air intake temperature and outlet temperature, detection result by the humidity sensor, and the dew point temperature.

Controller 30B determines that there is a risk of dew condensation if the temperature at the evaporator outlet is lower than dew point temperature Tsat and determines that there is no risk of dew condensation if the temperature at the evaporator outlet is higher than dew point temperature Tsat.

If there is a risk of frost formation at step S81 (YES at S81) or it is determined at step S82 that there is a risk of dew condensation (YES at S82), the process proceeds to step S83, so that controller 30B performs a process of reducing an inlet-outlet temperature difference. The process at step S83 is similar to the process of step S2 described with reference to FIG. 23. The description of the process of step S83 will thus not be repeated.

Contrastingly, if it is determined at step S82 that there is no risk of dew condensation (NO at S82), at step S84, the process of improving COP is performed. The process of step S84 may be the process similar to the process of step S53 described with reference to FIG. 26. In the process of calculating COP, Q1 and Q2 may be the capability (Q=Ga×ΔH) calculated from the results of computations of the inlet and outlet enthalpies used to determine dew condensation. In addition to switching of linear flow path switching valve 12 on the evaporation side, linear flow path switching valve 12 on the condensation side may be switched to calculate four types of COP, and the condition for achieving maximum COP may be extracted, thereby performing switching.

As shown in FIG. 27, refrigeration cycle apparatus 50B according to Embodiment 3 further includes humidity sensors 200*a* and 200*b*. Also, as shown in FIG. 28, if both the refrigerant temperature at the inlet and the refrigerant temperature at the outlet are higher than the frost formation determination temperature (NO at S81) and if the output of the humidity sensor is lower than the condensation determination humidity (NO at S82), controller 30B changes the connections of refrigerant flow paths 10*a* and 10*b* to change the number of flow paths, thereby increasing the coefficient of performance of the refrigeration cycle apparatus (S84). The flow of FIG. 28 returns (at S85).

The refrigeration cycle apparatus according to Embodiment 3 determines a possibility of frost formation, and accordingly, can prevent partial frost formation. In addition, since the presence or absence of dew condensation is determined from the detection results of the temperature and humidify, partial dew condensation can be prevented. Moreover, the operation of reducing power consumption further can be performed in the operation range free from frost formation and dew condensation. Power consumption can be accordingly reduced further in equal-capability output, thus improving COP.

[Various Modifications]

FIG. 29 is a block diagram showing a configuration of Modification 1 of a refrigeration cycle apparatus applicable to Embodiments 1 to 3. With reference to FIG. 29, a refrigeration cycle apparatus 66 includes a six-way valve 102, a flow path switching device 212, compressor 1, expansion valves 7 and 7*d*, first heat exchange unit 5*a* and second heat exchange unit 5*b*, outlet header 6, pipe 16 (between confluence 15 and first heat exchange unit 5*a*) and temperature sensors 105*a* and 105*b*.

Flow path switching device 212 includes a first inlet header 4*a* configured to distribute refrigerant to a plurality of (e.g., four) refrigerant flow paths of first heat exchange unit 5*a*, a second inlet header 4*b* configured to distribute refrigerant to a plurality of (e.g., four) refrigerant flow paths of first heat exchange unit 5*a* and second heat exchange unit 5*b*, and switching valves 3*a* and 3*b*.

Although FIG. 29 does not show controller 30 of FIG. 1 to avoid complexity, the controller that controls six-way valve 102 and switching valves 3*a* and 3*b* is provided as in FIG. 1. The same applies to FIG. 29 and the following figures. Six-way valve 102 is a multi-way valve having a function similar to that of four-way valve 2 of FIG. 1 and can cause the direction of refrigerant flow in the heat exchanger to be the same direction during cooling and during heating.

Figure 30:
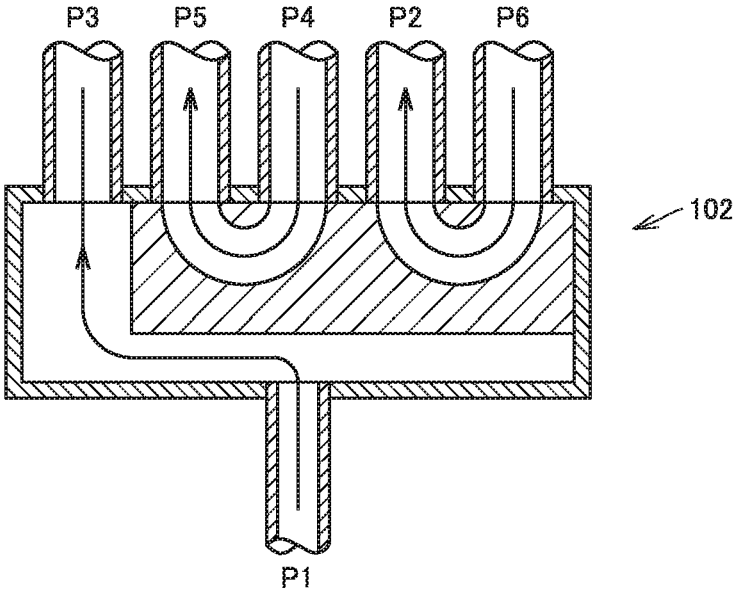
FIG. 30 shows a first state of a six-way valve in FIG. 29.
Figure 31:
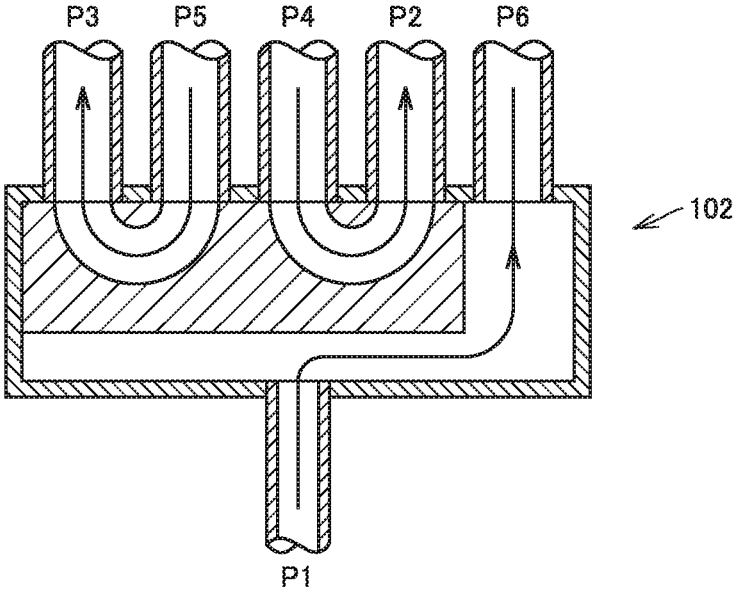
FIG. 31 shows a second state of the six-way valve in FIG. 29.

FIG. 30 shows a first state of the six-way valve in FIG. 29. FIG. 31 shows a second state of the six-way valve in FIG. 29.

Six-way valve 102 includes a valve main body with a hollow formed therein and a sliding valve main body that slides inside the valve main body.

During cooling, the sliding valve main body in six-way valve 102 is set to the state shown in FIG. 30. In this case, a flow path is formed to cause refrigerant to flow from a port P1 to a port P3, cause refrigerant to flow from a port P4 to a port P5, and cause refrigerant to flow from a port P6 to a port P2.

During heating, the sliding valve main body in six-way valve 102 is set to the state shown in FIG. 31. In this case, a flow path is formed to cause refrigerant to flow from port P1 to port P6, cause refrigerant to flow from port P5 to port P3, and cause refrigerant to flow from port P4 to port P2.

Switching six-way valve 102 as shown in FIGS. 30 and 31 causes refrigerant to flow as indicated the solid arrows in FIG. 29 during cooling operation and refrigerant to flow as indicated by the broken arrows in FIG. 29 during heating operation. At this switching, switching valves 3*a* and 3*b* of flow path switching device 112 in association with switching of six-way valve 102 also changes the relationship of connection between first heat exchange unit 5*a* and second heat exchange unit 5*b*, and also switches a distributor used to distribute refrigerant to a plurality of refrigerant flow paths of first heat exchange unit 5*a*.

First flow path switching valve 3*a* is configured to cause refrigerant to pass through inlet header 4*a* when the circulation direction is a first direction (cooling) and cause refrigerant to pass through inlet header 4*b* when the circulation direction is a second direction (heating). Switching valve 3*b* is configured to connect refrigerant outlet header 6 of first heat exchange unit 5*a* to the refrigerant inlet of second heat exchange unit 5*b* when the circulation direction is the first direction (cooling) and cause refrigerant outlet header 6 of first heat exchange unit 5*a* to meet the outlet of second heat exchange unit 5*b* when the circulation direction is the second direction (heating).

Figure 32:
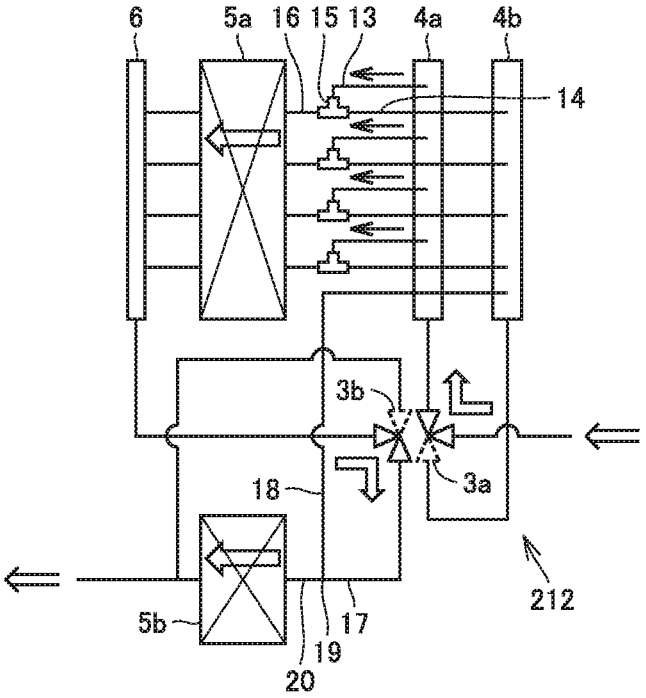
FIG. 32 shows a flow of refrigerant in an outdoor heat exchanger with a small number of flow paths.

FIG. 32 shows a flow of refrigerant in the outdoor heat exchanger with a small number of flow paths. With reference to FIGS. 29 and 32, in the initial state during cooling, first flow path switching valve 3*a* is set to guide refrigerant that has flowed from compressor 1 into flow path switching device 212 to inlet header 4*a*. At this time, the flow path leading to inlet header 4*b* is closed, and accordingly, refrigerant does not flow through inlet header 4*b*. First flow path switching valve 3*a* causes inlet header 4*a* to be used in distribution of refrigerant during cooling. Also illustrated are pipes 17, 18, 19 and 20 between second heat exchange unit 5*b*, inlet header 4*b*, and switching valve 3*b*.

In the initial state during cooling, switching valve 3*b* is set to connect first heat exchange unit 5*a* and second heat exchange unit 5*b* in series. This causes refrigerant that has passed through first heat exchange unit 5*a* and outlet header 6 from inlet header 4*a* to flow through second heat exchange unit 5*b* in the initial state during cooling.

Consequently, in the initial state during cooling, high-temperature, high-pressure gas refrigerant flows from compressor 1 into flow path switching device 212, passes through first flow path switching valve 3*a* and first inlet header 4*a*, and then flows into first heat exchange unit 5*a*. The incoming refrigerant condenses, passes from first heat exchange unit 5*a* through outlet header 6 and second flow path switching valve 3*b*, and condenses further in second heat exchange unit 5*b*. The refrigerant that has condensed in second heat exchange unit 5*b* further passes through six-way valve 102 and flows from expansion valve 7 to indoor heat exchanger 8 to evaporate in indoor heat exchanger 8. The refrigerant then returns to compressor 1 through six-way valve 102 (see the solid arrows in FIG. 29).

Figure 33:
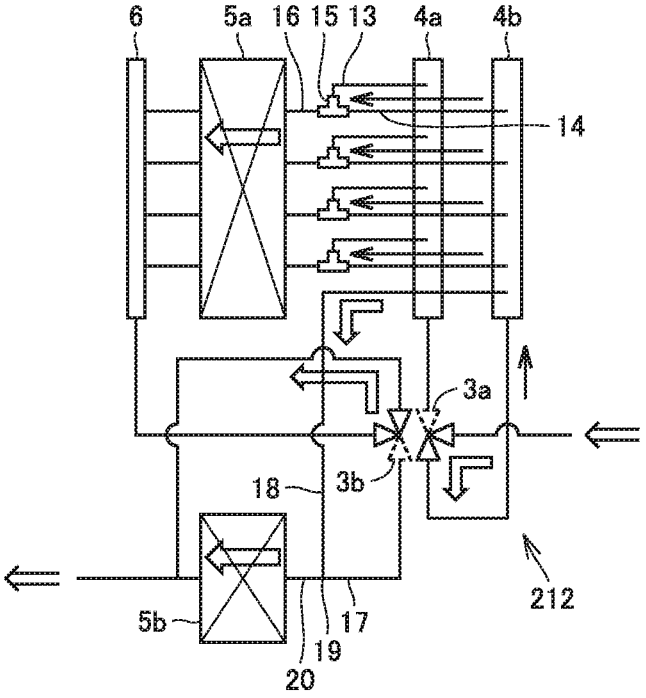
FIG. 33 shows a flow of refrigerant in the outdoor heat exchanger with a large number of flow paths.

FIG. 33 shows a flow of refrigerant in the outdoor heat exchanger with a large number of flow paths. With reference to FIGS. 29 and 33, in the initial state during heating, first flow path switching valve 3*a* is set to guide refrigerant that has flowed from expansion valve 7 into flow path switching device 212 to inlet header 4*b*. At this time, a flow path leading to inlet header 4*a* is closed, and accordingly, refrigerant does not flow through inlet header 4*a*. First flow path switching valve 3*a* causes inlet header 4*b* to be used to distribute refrigerant during heating.

In the initial state during heating, switching valve 3*b* is set to connect first heat exchange unit 5*a* and second heat exchange unit 5*b* in parallel. This causes the refrigerant that has distributed from inlet header 4*b* to first heat exchange unit 5*a* and the refrigerant that has distributed from inlet header 4*b* to second heat exchange unit 5*b* to flow through first heat exchange unit 5*a* and second heat exchange unit 5*b* in parallel, and then meet together.

Consequently, in the initial state during heating, high-temperature, high-pressure gas refrigerant discharged from compressor 1 flows through six-way valve 102 into indoor heat exchanger 8, and condenses. The refrigerant then flows through expansion valve 7 and six-way valve 102 into first flow path switching valve 3*a*. The refrigerant further flows from first flow path switching valve 3*a* through second inlet header 4*b* into first heat exchange unit 5*a* and second heat exchange unit 5*b*, and evaporates in first heat exchange unit 5*a* and second heat exchange unit 5*b*. The refrigerant that has flowed into first heat exchange unit 5*a* flows through outlet header 6 and second flow path switching valve 3*b*, and then meets the refrigerant that has passed through second heat exchange unit 5*b* on the outlet side of second heat exchange unit 5*b*. The resultant refrigerant further returns to compressor 1 through six-way valve 102 (see the broken arrows in FIG. 29).

Figure 34:
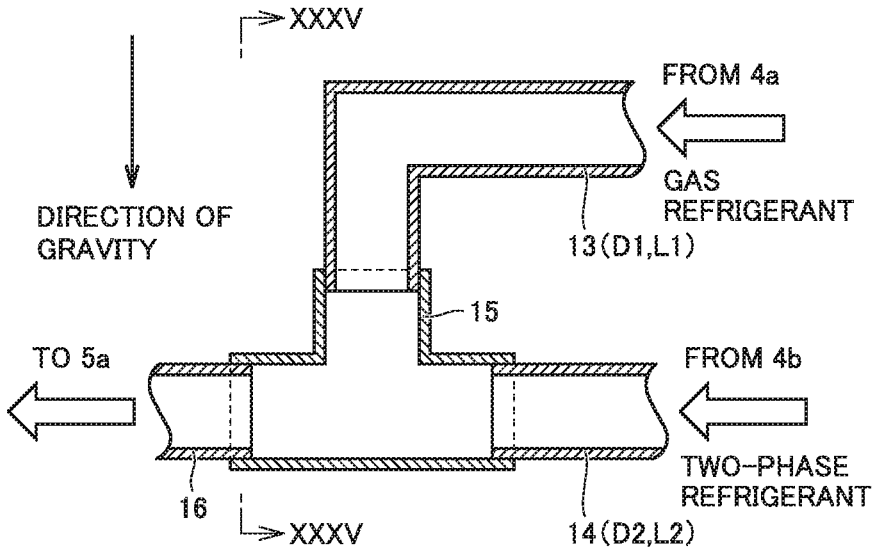
FIG. 34 is a diagram for illustrating an example arrangement of pipes at a confluence of the present embodiment.
Figure 35:
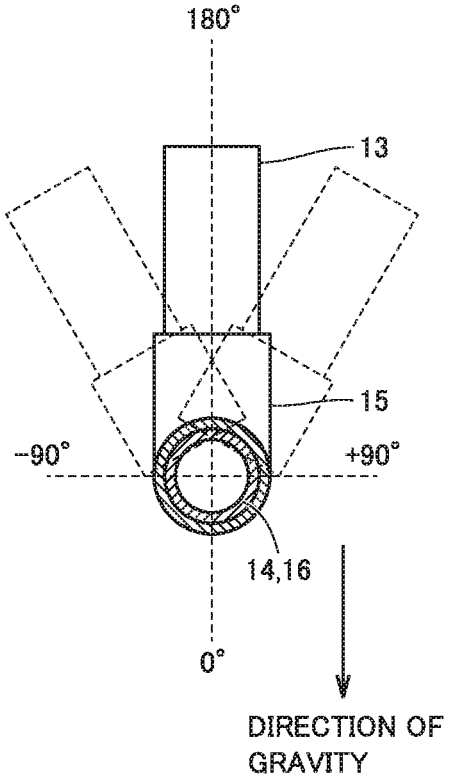
FIG. 35 shows the confluence of the pipes shown in FIG. 34, which is viewed from direction XXXV-XXXV.
Figure 36:
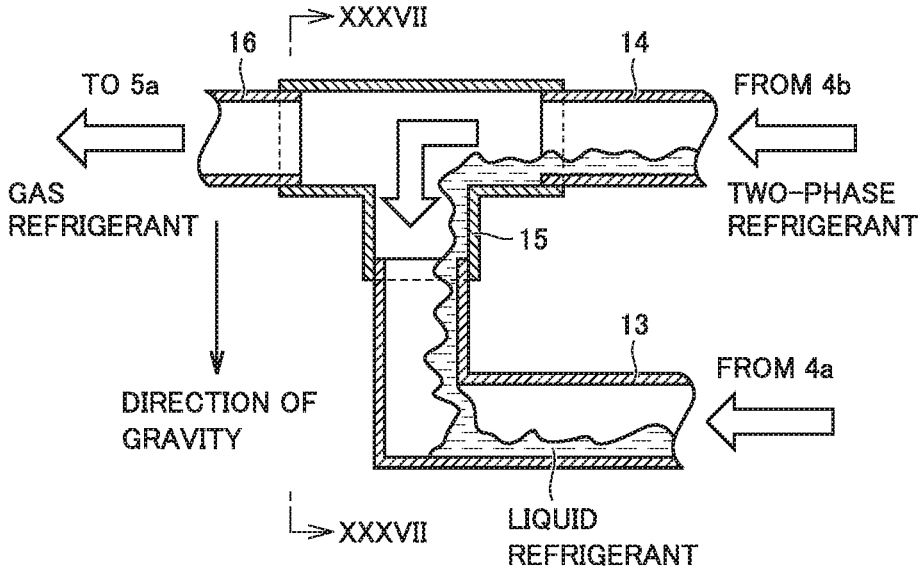
FIG. 36 is a diagram for illustrating an example arrangement of pipes at a confluence of a comparative example.
Figure 37:
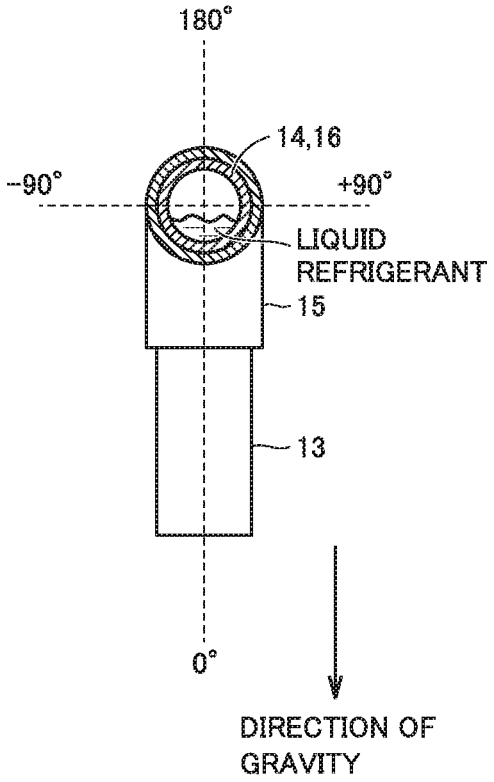
FIG. 37 shows the confluence of the pipes shown in FIG. 36, which is viewed from direction XXXVII-XXXVII.

Further, there is a preferable arrangement as to the arrangement of pipes in a confluence 15. FIG. 34 is a diagram for illustrating an example arrangement of pipes at the confluence in the present embodiment. FIG. 35 shows the confluence for pipes shown in FIG. 34, which is taken from XXXV-XXXV direction. FIG. 36 is a diagram for illustrating an example arrangement of pipes at the confluence in a comparative example. FIG. 37 shows the confluence for pipes shown in FIG. 36, which is viewed from XXXVII-XXXVII direction.

As in the comparative example shown in FIGS. 36 and 37, attaching pipe 13 to make an angle at pipe 13 to be equal to the angle in the direction of gravity (0°) allows liquid refrigerant to flow into pipe 13 when two-phase refrigerant flows from pipe 14 into heat exchange unit 5*a*. This is not preferable from the view point of effective use of refrigerant.

In the present embodiment, thus, pipe 13 is located above pipe 14 in the direction of gravity, and the angle at which pipe 13 is attached to confluence 15 such that $90° < \theta \leq 180°$ or $-180° \leq \theta < -90°$, where the direction of gravity is 0° as indicated by the broken lines as shown in FIG. 35. Pipe 13 is most preferably attached to provide an angle of ±180° as indicated by the solid line.

Refrigeration cycle apparatus 66 adopts a configuration in which flow paths are switched, also in the indoor unit. The indoor unit of refrigeration cycle apparatus 66 includes heat exchange units 8*a* and 8*b* obtained by dividing the indoor heat exchanger, outlet header 9, a flow path switching device 1612 that switches the connections of heat exchange units 8*a* and 8*b*, and temperature sensors 108*a* and 108*b*. Flow path switching device 1612 includes inlet headers 1004a and 1004band switching valves 1003*a* and 1003*b*, and pipes 1013, 1014, 1016 and confluence 1015 analogous to pipes 13, 14, 16 and confluence 15.

The operation of refrigeration cycle apparatus 66 during cooling will now be described. During cooling, the six-way valve is controlled to form a flow path as indicated by the solid lines. Also in the initial state during cooling, a flow path is switched to the side indicated by the solid lines for switching valves 3*a*, 3*b*, 1003*a*, and 1003*b*. Expansion valve 7 is fully opened, and the degree of opening of expansion valve 7*d* is controlled as a normal expansion valve. As compressor 1 is operated, refrigerant flows as indicated by the solid arrows.

The refrigerant discharged from compressor 1 flows through ports P1 and P3 of six-way valve 102 and switching valve 3*a* into inlet header 4*a* of the outdoor heat exchanger, and is distributed to a plurality of flow paths of heat exchange unit 5*a*.

The refrigerant that has passed through heat exchange unit 5*a* flows through outlet header 6 and switching valve 3*b*, passes through heat exchange unit 5*b*, and then arrives at expansion valve 7*d*. The refrigerant that has been decompressed after passing through expansion valve 7*d* passes through ports P2 and P6 of six-way valve 102 and switching valve 1003*a* to inlet header 1004*b* of the indoor heat exchange unit to be distributed to a plurality of flow paths of heat exchange unit 8*a* and heat exchange unit 8*b*. The refrigerant that has passed through heat exchange unit 8*a* passes through outlet header 9 and switching valve 1003*b*, and meets the refrigerant that has passed through heat exchange unit 8*b*. The resultant refrigerant then passes through expansion valve 7 which is fully opened and ports P5 and P4 of six-way valve 102 and returns to the inlet of compressor 1.

As described above, in the initial state during cooling, heat exchange units 5*a* and 5*b* of the outdoor unit are connected in series, and heat exchange units 8*a* and 8*b* of the indoor unit are connected in parallel.

The operation of refrigeration cycle apparatus 66 in the initial state during heating will now be described. During heating, six-way valve 102 is controlled to form a flow path as indicated by the broken lines. Also in the initial state during heating, a flow path is switched to the side indicated by the broken line for switching valves 3*a*, 3*b*, 1003*a*, and 1003*b*. Expansion valve 7*d* is fully opened, and the degree of opening of expansion valve 7 is controlled as a normal expansion valve. As compressor 1 is operated, refrigerant flows as indicated by the broken arrows.

The refrigerant discharged from compressor 1 flows through ports P1 and P6 of six-way valve 102 and switching valve 1003*a* into inlet header 1004*a* of the indoor heat exchanger, and is distributed to a plurality of flow paths of heat exchange unit 8*a*.

The refrigerant that has passed through heat exchange unit 8*a* passes through outlet header 9 and switching valve 1003*b*, passes through heat exchange unit 8*b*, and then arrives at expansion valve 7. The refrigerant that has been decompressed while passing through expansion valve 7 arrives at inlet header 4*b* of the outdoor heat exchange unit through ports P5 and P3 of six-way valve 102 and first flow path switching valve 3*a*, and is distributed to a plurality of flow paths of heat exchange unit 5*a* and the flow path of heat exchange unit 5*b*. The refrigerant that has passed through heat exchange unit 5*a* passes through outlet header 6 and switching valve 3*b* and meets the refrigerant that has passed through heat exchange unit 5*b*. The resultant refrigerant then passes through expansion valve 7*d* which is fully opened and ports P2 and P4 of the six-way valve and returns to the inlet of the compressor.

As described above, in the initial state during heating, heat exchange units 5*a* and 5*b* of the outdoor unit are connected in parallel, and heat exchange units 8*a* and 8*b* of the indoor unit are connected in series.

Also refrigeration cycle apparatus 66 having the above configuration can detect an inlet-outlet refrigerant temperature difference of the outdoor heat exchanger by temperature sensors 105*a* and 105*b* and select the number of flow paths that reduces a temperature difference as in Embodiment 1. Similarly, temperature sensors 108*a* and 108*b* can detect an inlet-outlet refrigerant temperature difference of the indoor heat exchanger, and the number of flow paths that reduces a temperature difference can be selected as in Embodiment 1.

The refrigeration cycle apparatus of Modification 1 can be formed such that the first heat exchange unit has a higher capacity of the heat exchanger and a larger number of flow paths than those of the second heat exchange unit in each of the outdoor unit and the indoor unit, so that an optimum number of flow paths can be formed in the initial state during each of cooling and heating. This can improve heat transfer performance in the liquid-phase region with a small pressure loss while reducing a pressure loss in the gas and two-phase regions.

Forming first heat exchange unit 5*a* to be larger than second heat exchange unit 5*b* in the outdoor unit can increase the ratio of the liquid-phase region of the refrigerant flowing into second heat exchange unit 5*b* to provide a lower flow rate during cooling.

Forming first heat exchange unit 8*a* to be larger than second heat exchange unit 8*b* in the indoor unit can increase the ratio of the liquid-phase region of the refrigerant flowing into second heat exchange unit 8*b* to provide a lower flow rate during heating.

In each of the outdoor unit and the indoor unit, a distributor is changed during cooling and during heating to evenly distribute refrigerant, thus improving heat transfer performance. Improved heat transfer performance can reduce the operating pressure of the refrigeration cycle on the high pressure side and increase the operating pressure on the low pressure side. The operating pressure of the refrigeration cycle decreases on the high pressure side and increases on the low pressure side, reducing an input to the compressor, which improves the performance of the refrigeration cycle.

Since the direction in which refrigerant circulates to the heat exchanger can be made the same during heating and during cooling, flows of refrigerant and air can be made counterflows during cooling and during heating. Counterflows can be constantly provided in cooling and heating, achieving a more temperature difference between refrigerant and air than during parallel flow.

Selection of flow paths is performed in the initial state during cooling and during heating and the number of flow paths is changed to reduce an inlet-outlet refrigerant temperature difference of the evaporator during cooling operation or during heating operation as described above, thereby preventing frost formation and dew condensation while keeping the temperature of saturated gas that is incombustible and has a low GWP at atmospheric pressure during the use of non-azeotropic refrigerant mixture at −40° C. or lower, as in Embodiments 1 to 3. A decrease in efficiency due to, for example, a frequent occurrence of defrosting operation can thus be prevented. Further, COP can be improved by control performed as in Embodiments 2 and 3.

Flow path switching device 212 and flow path switching device 1612 of the modification shown in FIG. 29 can be achieved with various configurations. Some configuration examples will now be described.

Figure 38:
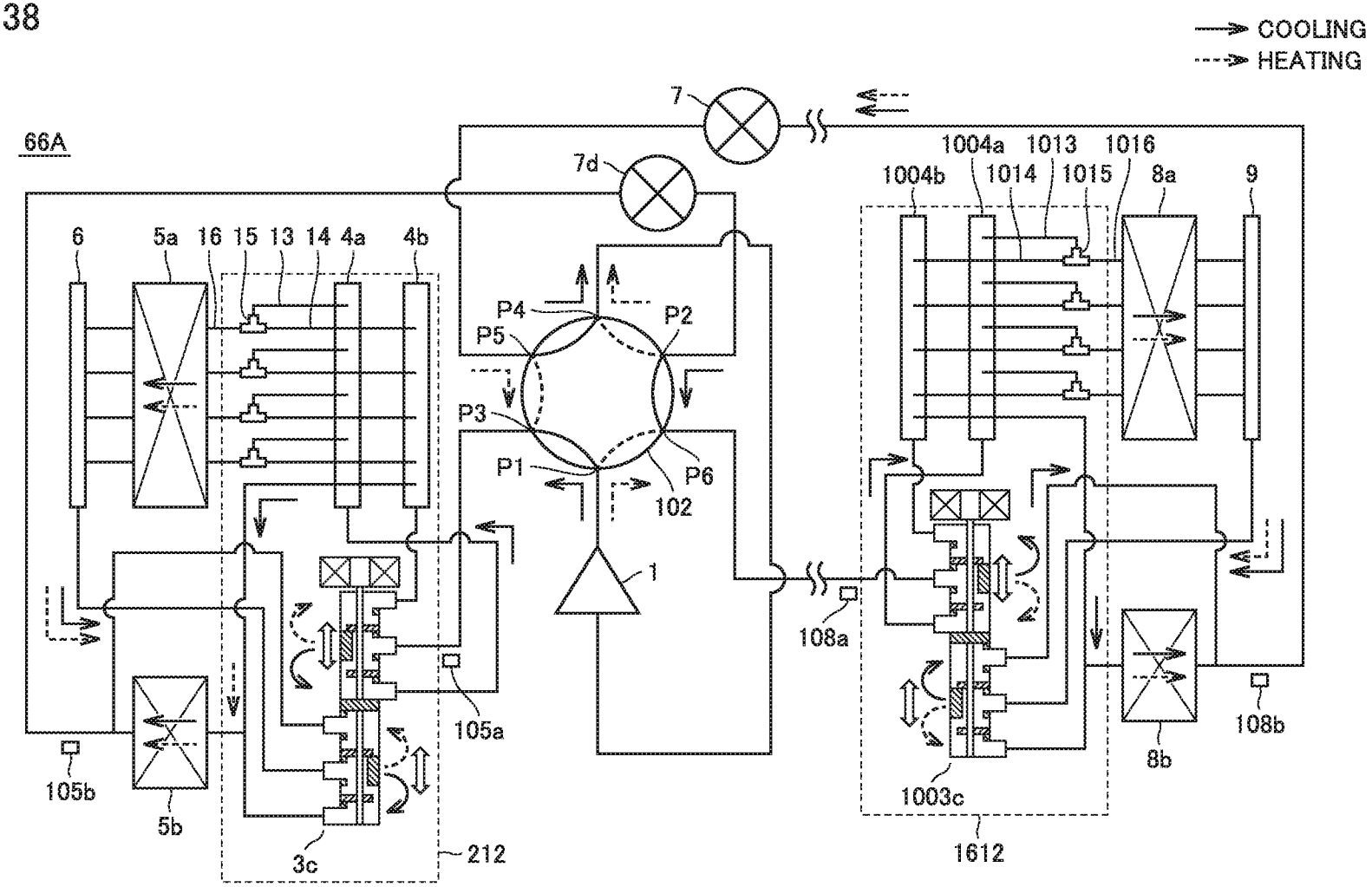
FIG. 38 is a block diagram showing a configuration of Modification 2 of the refrigeration cycle apparatus applicable to Embodiments 1 to 3.

FIG. 38 is a block diagram showing a configuration of Modification 2 of the refrigeration cycle apparatus applicable to Embodiments 1 to 3. A refrigeration cycle apparatus 66A shown in FIG. 38 includes a linear switching valve 3*c* in place of switching valves 3*a* and 3*b* and includes a linear switching valve 1003*c* in place of switching valves 1003*a* and 1003*b* in the configuration of refrigeration cycle apparatus 66 shown in FIG. 29. The other configuration of refrigeration cycle apparatus 66A is similar to that of refrigeration cycle apparatus 66, description of which will not be repeated.

Figure 39:
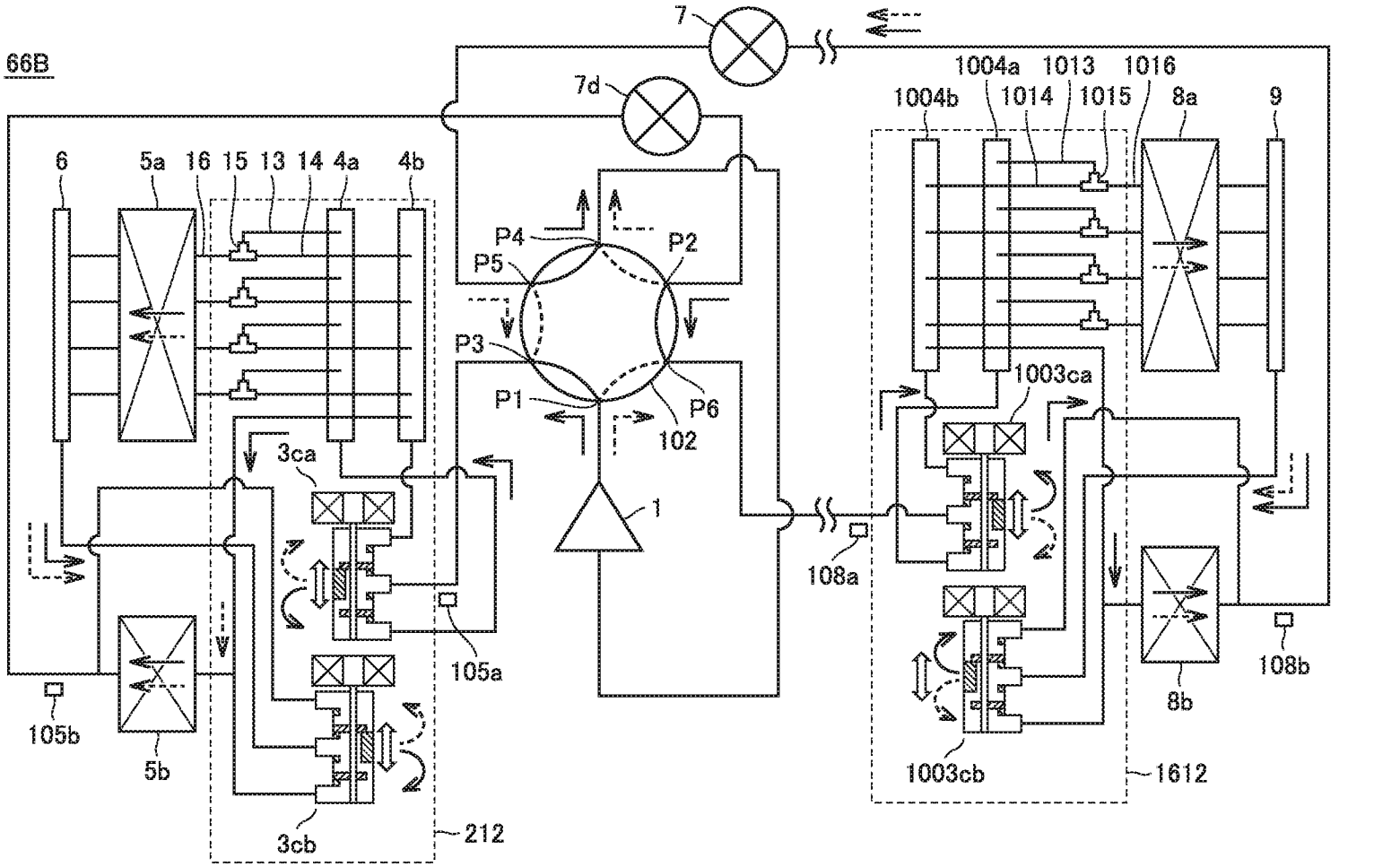
FIG. 39 is a block diagram showing a configuration of Modification 3 of the refrigeration cycle apparatus applicable to Embodiments 1 to 3.

FIG. 39 is a block diagram showing a configuration of Modification 3 of the refrigeration cycle apparatus applicable to Embodiments 1 to 3. A refrigeration cycle apparatus 66B shown in FIG. 39 is obtained by dividing linear switching valve 3*c* into two linear switching valves 3*ca* and 3*cb* and dividing linear switching valve 1003*c* into two linear switching valves 1003*a* and 1003*b* in the configuration of refrigeration cycle apparatus 66A shown in FIG. 38. The other configuration of refrigeration cycle apparatus 66B is similar to that of refrigeration cycle apparatus 66A, description of which will not be repeated.

Figure 40:
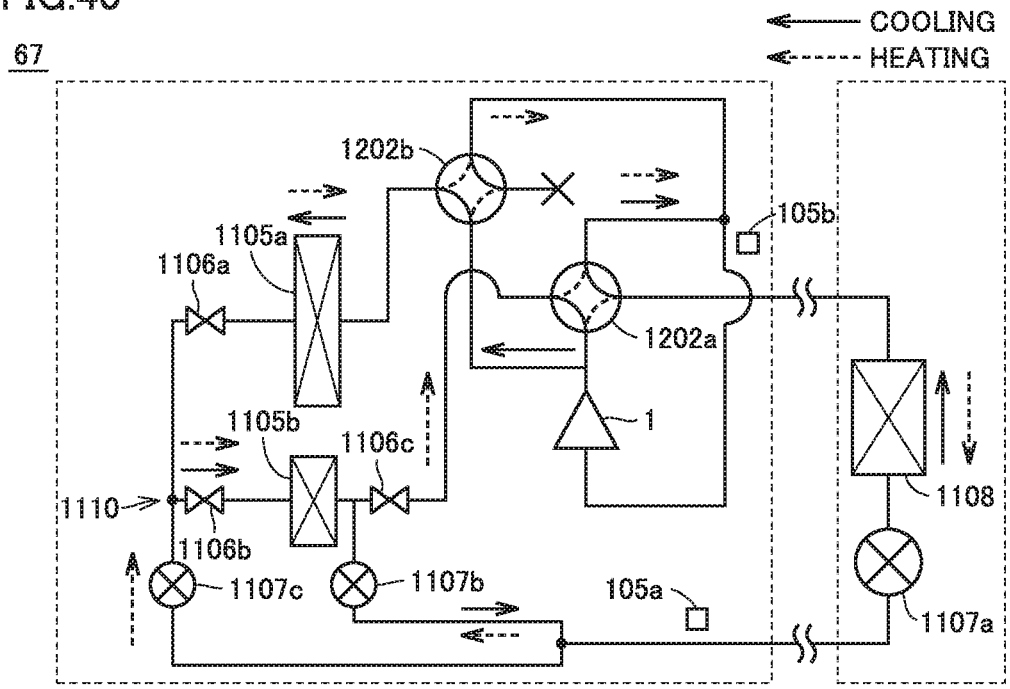
FIG. 40 is a block diagram showing a configuration of Modification 4 of the refrigeration cycle apparatus applicable to Embodiments 1 to 3.

FIG. 40 is a block diagram showing a configuration of Modification 4 of the refrigeration cycle apparatus applicable to Embodiments 1 to 3. With reference to FIG. 40, a refrigeration cycle apparatus 67 includes compressor 1, a flow path switching device 1202 including a first four-way valve 1202*a* and a second four-way valve 1202*b*, an outdoor heat exchanger 1105 including a first heat exchange unit 1105*a* and a second heat exchange unit 1105*b*, a flow path changing device 10 (first on-off valve 1106*a*, second on-off valve 1106*b*, third on-off valve 1106*c*, second expansion valve 1107*b*, third expansion valve 1107*c*), a first expansion valve 1107*a*, and an indoor heat exchanger 1108.

Although first expansion valve 1107*a* is provided in the indoor unit in FIG. 40, it may be provided upstream of a branch point between second expansion valve 1107*b* and third expansion valve 1107*c* of the outdoor unit.

A header and a distributor, which are not shown, may be provided upstream and downstream of first heat exchange unit 1105*a* and second heat exchange unit 1105*b*.

An operation of a refrigeration cycle apparatus according to Embodiment 5 which has the above configuration will now be described.

During cooling, first four-way valve 1202*a* and second four-way valve 1202*b* are switched to the cooling mode (solid lines). Also, first on-off valve 1106*a* and second on-off valve 1106*b* are opened, third on-off valve 1106*c* is closed, third expansion valve 1107*c* is closed, and second expansion valve 1107*b* is opened. Consequently, first heat exchange unit 1105*a* and second heat exchange unit 1105*b* are connected in series. This causes refrigerant to flow from compressor 1 through second four-way valve 1202*b* into first heat exchange unit 1105*a*. The refrigerant condenses in first heat exchange unit 1105*a* and flows through first on-off valve 1106*a* and second on-off valve 1106*b* into second heat exchange unit 1105*b*. The refrigerant further condenses in second heat exchange unit 1105*b*, passes through second expansion valve 1107*b*, and expands in first expansion valve 1107*a*. The refrigerant then evaporates in indoor heat exchanger 1108 and returns to compressor 1 through first four-way valve 1202*a*.

In the initial state during heating, first four-way valve 1202*a* and second four-way valve 1202*b* are switched to the heating mode (broken lines). Also, first on-off valve 1106*a*, second on-off valve 1106*b*, and third on-off valve 1106*c* are opened, third expansion valve 1107*c* is opened, and second expansion valve 1107*b* is closed. Consequently, first heat exchange unit 1105*a* and second heat exchange unit 1105*b* are connected in parallel. This causes refrigerant to flow from compressor 1 through first four-way valve 1202*a* into indoor heat exchanger 1108. The refrigerant condenses in indoor heat exchanger 1108, passes through first expansion valve 1107*a* and third expansion valve 1107*c*, and is branched to first on-off valve 1106*a* and second on-off valve 1106*b*. The refrigerant that has flowed through first on-off valve 1106*a* evaporates in first heat exchange unit 1105*a*, and returns to compressor 1 through second four-way valve 1202*b*. The refrigerant that has flowed through second on-off valve 1106*b* evaporates in second heat exchange unit 1105*b* and returns to compressor 1 through third on-off valve 1106*c* and first four-way valve 1202*a*.

When the refrigerant inlet-outlet temperature difference of the outdoor heat exchanger which has been detected by temperature sensors 105*a* and 105*b* is not nearly zero, first heat exchange unit 1105*a* and second heat exchange unit 1105*b* connected in parallel are reconnected in series, and whether the temperature difference decreases is determined, as in the process shown in FIG. 23. First on-off valve 1106*a*, second on-off valve 1106*b*, and second expansion valve 1107*b* are opened, and third expansion valve 1107*c* and third on-off valve 1106*c* are closed, so that first heat exchange unit 1105*a* and second heat exchange unit 1105*b* are connected in series.

Consequently, refrigerant flows from compressor 1 through first four-way valve 1202*a* into indoor heat exchanger 1108. The refrigerant condenses in indoor heat exchanger 1108, flows through first expansion valve 1107*a* and second expansion valve 1107*b*, and then evaporates in second heat exchange unit 1105*b*. The refrigerant subsequently passes through second on-off valve 1106*b* and first on-off valve 1106*a*, and further evaporates in first heat exchange unit 1105*a*, and then returns to compressor 1 through second four-way valve 1202*b*.

The current state (series connection) is maintained if the temperature difference has decreased after a lapse of a predetermined period of time in this state and is returned to the original state (parallel connection) if the temperature difference has increased.

Also in such a configuration, the configuration of flow paths of the evaporator can be switched during heating operation to prevent partial frost formation or improve COP by reducing a temperature difference between the temperature at the refrigerant inlet and the temperature at the refrigerant outlet. Indoor heat exchanger 1108 may also adopt a divided configuration in FIG. 40 to switch the configuration of flow paths.

The combination and composition range of refrigerant described in Embodiment 1 disclosed herein are merely examples, and non-azeotropic refrigerant mixture obtained by combining three or more types of refrigerants may suffice. For example, the refrigerant may be a four-type-mixed refrigerant of R32, R125, R134a, and R1234yf or a five-type-mixed refrigerant of R32, R125, R134a, R1234yf, and CO2. Although a temperature gradient occurring in each non-azeotropic refrigerant mixture differs, similar effects can be achieved in the present embodiment.

It should be construed that the embodiments disclosed herein are given by way of illustration in all respects, not by way of limitation. It is therefore intended that the scope of the present invention is defined by claims, not only by the embodiments described above, and encompasses all modifications and variations equivalent in meaning and scope to the claims.

The invention claimed is:

1. A refrigeration cycle apparatus comprising a refrigeration circuit in which non-azeotropic refrigerant mixture circulates, the refrigeration circuit comprising a compressor, a first heat exchanger, a second heat exchanger, an expansion valve, and a multi-way valve, the multi-way valve having (i) a first state in which the non-azeotropic refrigerant mixture flows in order of the first heat exchanger, the expansion valve, and the second heat exchanger, and (ii) a second state in which the non-azeotropic refrigerant mixture flows in order of the second heat exchanger, the expansion valve, and the first heat exchanger, the first heat exchanger comprising a plurality of refrigerant flow paths, and a linear flow path switching device valve configured to switch connections of the plurality of refrigerant flow paths between (a) a series state in which the non-azeotropic refrigerant mixture flows through the plurality of refrigerant flow paths in series and (b) a parallel state in which the non-azeotropic refrigerant mixture flows through the plurality of refrigerant flow paths in parallel, the refrigeration cycle apparatus further comprising a controller configured to switch the linear flow path switching valve between the series state and the parallel state when the multi-way valve is in the second state, wherein the controller is configured to, in switching of the connections of the plurality of refrigerant flow paths, maintain a connection state after the switching when a temperature difference between a refrigerant temperature at an inlet of the first heat exchanger and a refrigerant temperature at an outlet of the first heat exchanger decreases, and return the connection state after the switching to the connection state immediately before the switching when the temperature difference increases.

2. The refrigeration cycle apparatus according to claim 1, wherein the controller is configured to, when the refrigerant temperature at the inlet and the refrigerant temperature at the outlet are higher than a frost formation determination temperature, change the connections of the plurality of refrigerant flow paths to increase a coefficient of performance of the refrigeration cycle apparatus.

3. The refrigeration cycle apparatus according to claim 2, further comprising a wattmeter configured to detect power consumption of the refrigeration cycle apparatus, wherein the controller is further configured to, in an alternative operation, be capable of, in switching of the connections of the plurality of refrigerant flow paths, maintain a connection state after the switching when the coefficient of performance calculated based on a value measured by the wattmeter is higher than a value before the switching, and return the connection state after the switching to the original connection state immediately before the switching when the coefficient of performance decreases.

4. The refrigeration cycle apparatus according to claim 1, further comprising a humidity sensor, wherein the controller is configured to, when the refrigerant temperature at the inlet and the refrigerant temperature at the outlet are higher than a frost formation determination temperature and when an output from the humidity sensor is lower than a dew condensation determination humidity, change the connections of the plurality of refrigerant flow paths to increase a coefficient of performance of the refrigeration cycle apparatus.

5. The refrigeration cycle apparatus according to claim 1, wherein the first heat exchanger is placed in an outdoor unit, the second heat exchanger is placed in an indoor unit, and the linear flow path switching valve is configured to change the connections of the plurality of refrigerant flow paths during heating operation.

6. The refrigeration cycle apparatus according to claim 1, wherein the second heat exchanger is placed in an outdoor unit, the first heat exchanger is placed in an indoor unit, and the linear flow path switching valve changes the connections of the plurality of refrigerant flow paths during cooling operation.

7. The refrigeration cycle apparatus according to claim 1, wherein the first heat exchanger is divided into a first heat exchange unit having a first number of refrigerant flow paths of the plurality of refrigerant flow paths, and a second heat exchange unit having a second number of refrigerant flow paths of the plurality of refrigerant flow paths, the second number being smaller than the first number, and the linear flow path switching valve is configured to switch a connection flow path between the first heat exchange unit and the second heat exchange unit between (i) a first manner of flowing the non-azeotropic refrigerant mixture through the first heat exchange unit and the second heat exchange unit in parallel, and (ii) a second manner of flowing the non-azeotropic refrigerant mixture through the first heat exchange unit and the second heat exchange unit in series.

8. The refrigeration cycle apparatus according to claim 1, wherein the non-azeotropic refrigerant mixture is refrigerant containing a mixture of R125, R32, and R1234yf.

9. The refrigeration cycle apparatus according to claim 1, wherein the non-azeotropic refrigerant mixture is refrigerant containing a mixture of R125, R32, and R1123.

* * * * *